US009126778B2

(12) United States Patent
Kimura et al.

(10) Patent No.: US 9,126,778 B2
(45) Date of Patent: Sep. 8, 2015

(54) IMAGE FORMING SYSTEM, IMAGE FORMING APPARATUS, SHEET FEED APPARATUS, AND IMAGE FORMING METHOD

(71) Applicant: FUJI XEROX CO., LTD., Tokyo (JP)

(72) Inventors: Takuyoshi Kimura, Kanagawa (JP); Yoshinori Koike, Kanagawa (JP); Takehiko Koizumi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/277,479

(22) Filed: May 14, 2014

(65) Prior Publication Data

US 2015/0097333 A1 Apr. 9, 2015

(30) Foreign Application Priority Data

Oct. 7, 2013 (JP) ..... 2013-210519

(51) Int. Cl.
*B65H 9/00* (2006.01)
*B65H 7/02* (2006.01)
*B65H 7/20* (2006.01)

(52) U.S. Cl.
CPC ..... *B65H 9/002* (2013.01); *B65H 7/02* (2013.01); *B65H 7/20* (2013.01)

(58) Field of Classification Search
CPC ..... B65H 7/00; B65H 7/10; B65H 9/00; B65H 9/002; B65H 9/006; B65H 2301/3111; B65H 2301/30; B65H 2301/36; B65H 2301/3621
USPC ..... 271/227, 228, 236, 239, 242, 253
See application file for complete search history.

(56) References Cited

U.S. PATENT DOCUMENTS

| | | | | |
|---|---|---|---|---|
| 6,019,365 | A * | 2/2000 | Matsumura | 271/227 |
| 7,243,917 | B2 * | 7/2007 | Knierim et al. | 271/228 |
| 7,561,843 | B2 * | 7/2009 | deJong et al. | 399/364 |
| 2003/0020230 | A1 * | 1/2003 | Williams et al. | 271/227 |
| 2003/0020231 | A1 * | 1/2003 | Williams et al. | 271/227 |
| 2009/0154975 | A1 | 6/2009 | Ogata et al. | |
| 2011/0089623 | A1 * | 4/2011 | Kato et al. | 270/58.07 |
| 2013/0134662 | A1 * | 5/2013 | Moriya | 271/227 |
| 2013/0277909 | A1 * | 10/2013 | Ino | 271/228 |
| 2013/0300055 | A1 * | 11/2013 | Ishikawa et al. | 271/227 |
| 2013/0307213 | A1 * | 11/2013 | Adachi | 271/265.01 |

FOREIGN PATENT DOCUMENTS

| | | |
|---|---|---|
| JP | A-04-260558 | 9/1992 |
| JP | A-08-119503 | 5/1996 |
| JP | A-2009-143643 | 7/2009 |

* cited by examiner

*Primary Examiner* — David H Bollinger
(74) *Attorney, Agent, or Firm* — Oliff PLC

(57) ABSTRACT

An image forming system includes a feed section, a transport section, a transport position adjuster, and a load-position moving unit. The feed section feeds a sheet. The transport section transports the sheet fed from the feed section. The transport position adjuster adjusts a position of the sheet in an intersecting direction that intersects with a transport direction of the sheet transported by the transport section. The load-position moving unit moves the position, in the intersecting direction, of the sheet loaded in the feed section so as to reduce an adjustment amount by which the position is adjusted in the intersecting direction by the transport position adjuster if the adjustment amount is larger than a predetermined amount.

8 Claims, 15 Drawing Sheets

IMAGE FORMING SYSTEM, IMAGE FORMING APPARATUS, SHEET FEED APPARATUS, AND IMAGE FORMING METHOD

CROSS-REFERENCE TO RELATED APPLICATIONS

This application is based on and claims priority under 35 USC 119 from Japanese Patent Application No. 2013-210519 filed Oct. 7, 2013.

BACKGROUND

Technical Field

The present invention relates to image forming systems, image forming apparatuses, sheet feed apparatuses, and image forming methods.

SUMMARY

According to an aspect of the invention, there is provided an image forming system including a feed section, a transport section, a transport position adjuster, and a load-position moving unit. The feed section feeds a sheet. The transport section transports the sheet fed from the feed section. The transport position adjuster adjusts a position of the sheet in an intersecting direction that intersects with a transport direction of the sheet transported by the transport section. The load-position moving unit moves the position, in the intersecting direction, of the sheet loaded in the feed section so as to reduce an adjustment amount by which the position is adjusted in the intersecting direction by the transport position adjuster if the adjustment amount is larger than a predetermined amount.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail below with reference to the appended drawings.

Figure 1:
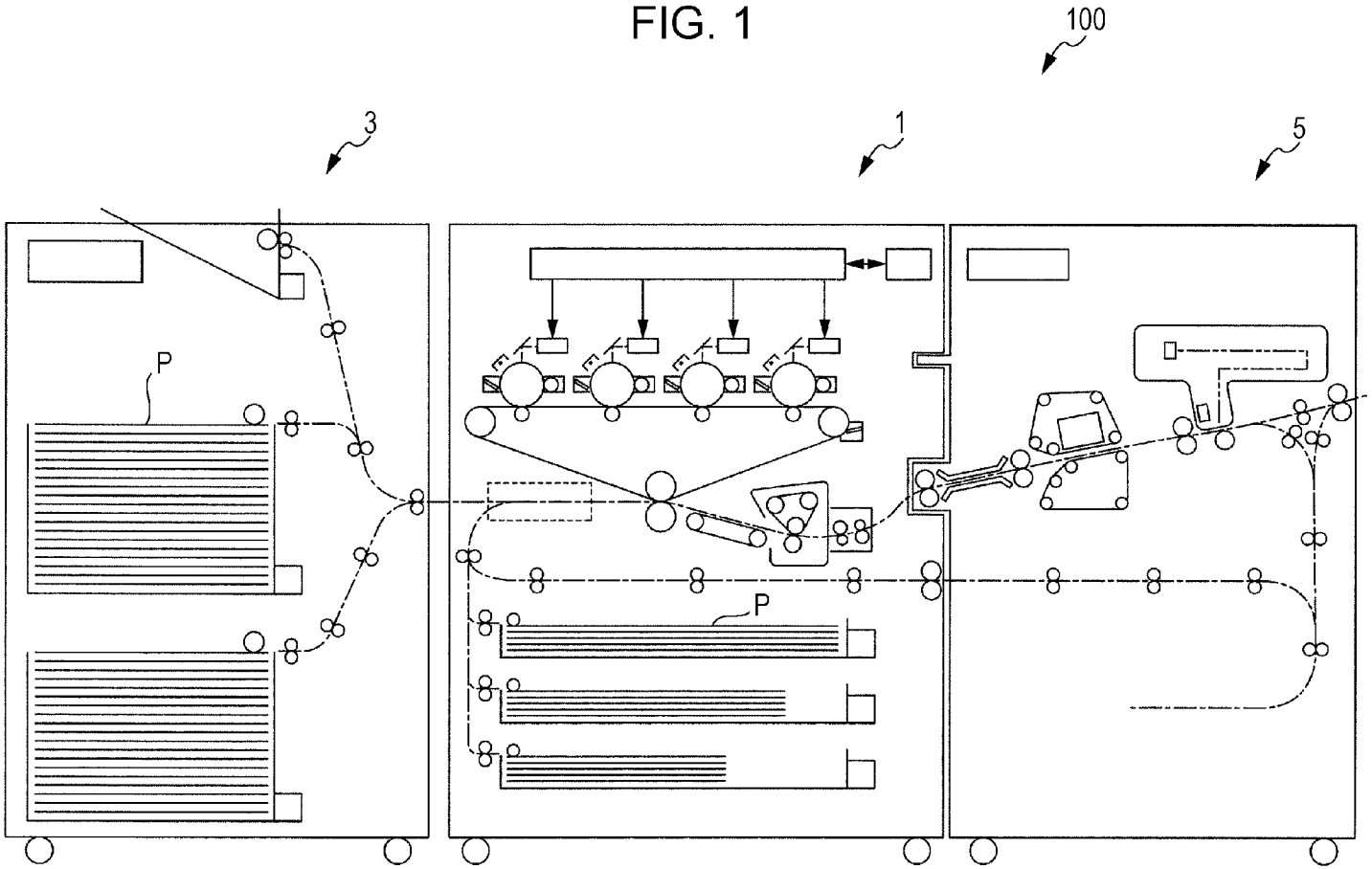
FIG. 1 illustrates the overall configuration of an image forming system to which an exemplary embodiment is applied.

FIG. 1 illustrates the overall configuration of an image forming system 100 according to the exemplary embodiment.

The image forming system 100 shown in FIG. 1 includes an image forming apparatus 1 that forms a color toner image onto a sheet P by, for example, electrophotography, a sheet feed apparatus 3 that holds a large number of sheets P and feeds the sheets P in a one-by-one manner to the image forming apparatus 1, and a sheet processing apparatus 5 that performs a predetermined process on the sheet P having the toner image formed thereon by the image forming apparatus 1.

Although the image forming apparatus 1 that forms an image by electrophotography is described as an example in this exemplary embodiment, the image forming apparatus 1 may alternatively be, for example, an inkjet printer.

Furthermore, although the sheet processing apparatus 5 that performs, for example, cooling on a sheet P is described as an example, the sheet processing apparatus 5 may include, for example, a binding device that performs a binding process on a stack of sheets P having images formed thereon or a punching device that performs a hole-punching process, so long as the apparatus is configured to perform a predetermined process on a sheet P having an image formed thereon.

The image forming apparatus 1 may be used alone as the image forming system 100. However, in this exemplary embodiment, the sheet feed apparatus 3 and the sheet processing apparatus 5 are connected as additional apparatuses (so-called optional apparatuses) to the image forming apparatus 1. Furthermore, although the sheet feed apparatus 3 and the sheet processing apparatus 5 are connected to the image forming apparatus 1 as an example shown in FIG. 1, one of the sheet feed apparatus 3 and the sheet processing apparatus 5 may be connected to the image forming apparatus 1. Moreover, the image forming apparatus 1 may be connected to an apparatus other than the sheet feed apparatus 3 and the sheet processing apparatus 5.

In the following description, the near side and the far side of the image forming system 100 shown in FIG. 1 may sometimes be referred to as "front side" and "rear side", respectively, and the depth direction of the image forming system 100 in FIG. 1 may sometimes be referred to as "depth direction".

Image Forming Apparatus 1

Figure 2:
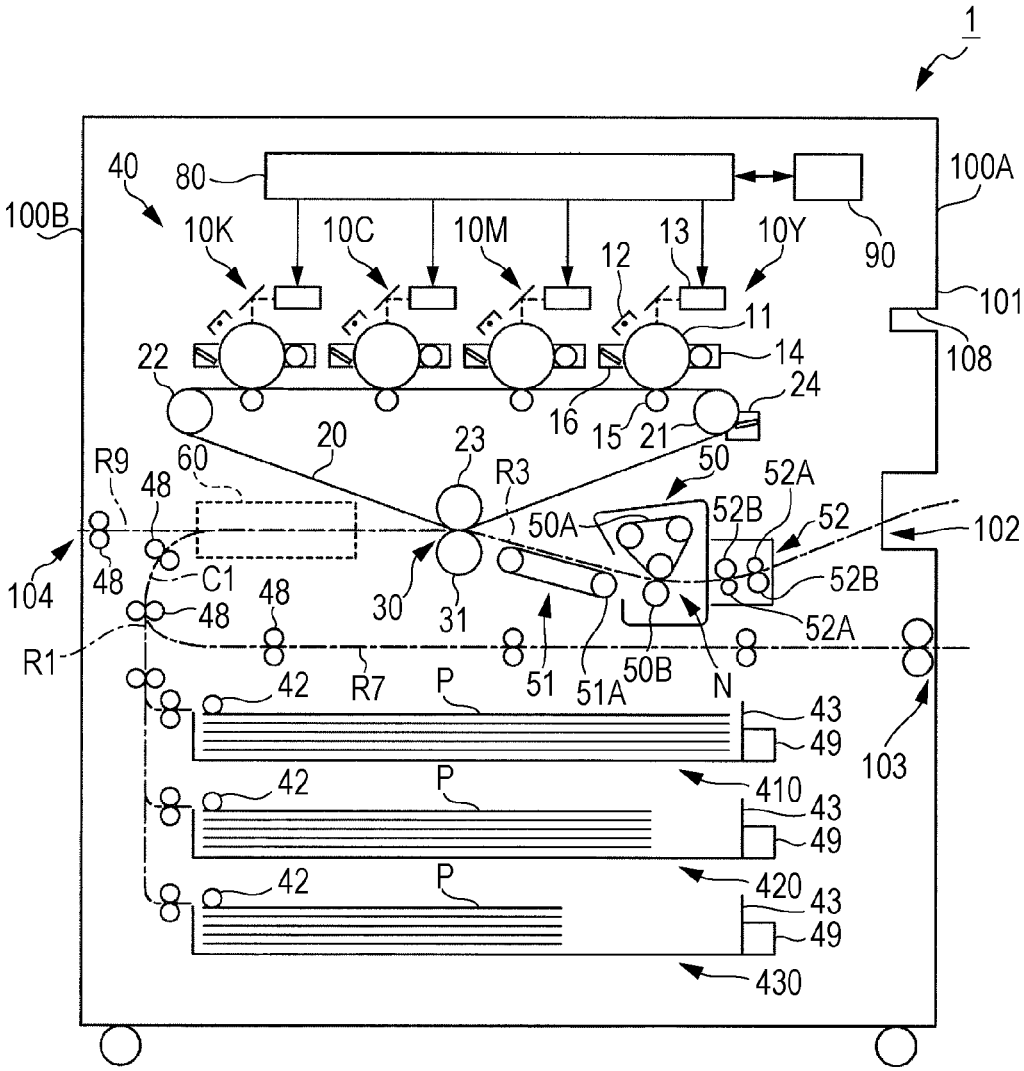
FIG. 2 illustrates the overall configuration of an image forming apparatus.

Next, the image forming apparatus 1 will be described with reference to FIG. 2. FIG. 2 illustrates the overall configuration of the image forming apparatus 1.

The image forming apparatus 1 shown in FIG. 2 has a so-called tandem-type configuration and includes multiple image forming units 10 (10Y, 10M, 10C, and 10K) that form toner images of different color components by electrophotography. The image forming apparatus 1 is provided with an integrated controller 80 (which will be described in detail later) that receives a print command or image data for image formation from, for example, a personal computer (PC, not shown) connected to the image forming apparatus 1 via a network and that controls the operation of each device and each section constituting the image forming apparatus 1. The image forming apparatus 1 is also provided with a user interface (UI) 90 that is constituted of a display panel. The UI 90 outputs a command received from a user to the integrated controller 80 and provides information from the integrated controller 80 to the user.

The image forming apparatus 1 further includes an intermediate transfer belt 20 onto which the toner images of the different color components formed at the respective image forming units 10 are sequentially transferred (first-transferred) and that bears the toner images, and a second-transfer device 30 that collectively transfers (second-transfers) the toner images on the intermediate transfer belt 20 onto a sheet P. The image forming units 10, the intermediate transfer belt 20, and the second-transfer device 30 may be considered as an image forming section 40.

The image forming apparatus 1 is provided with a first sheet transport path R1 used for transporting a sheet P toward the second-transfer device 30; a second sheet transport path R3 used for transporting the sheet P that has passed through the second-transfer device 30; a third sheet transport path R7 that extends from an end surface 100A, which faces the sheet processing apparatus 5, and connects to the first sheet transport path R1; and a fourth sheet transport path R9 that extends from an end surface 100B, which faces the sheet feed apparatus 3, and connects to the first sheet transport path R1.

Moreover, the image forming apparatus 1 is provided with a transport position adjuster 60 (which will be described in detail later) that adjusts the position of a sheet P transported toward the second-transfer device 30 along the first sheet transport path R1. The first sheet transport path R1 to the fourth sheet transport path R9 are provided with multiple transport rollers 48 as an example of transport sections that transport a sheet P.

The end surface 100A of a housing 101 is provided with openings 102 and 103, and the end surface 100B of the housing 101 is provided with an opening 104 as an example of a receiving section.

A sheet P transported along the second sheet transport path R3 is discharged toward the sheet processing apparatus 5 via the opening 102. A sheet P transported from the sheet processing apparatus 5 enters the housing 101 via the opening 103 and is transported along the third sheet transport path R7. A sheet P transported from the sheet feed apparatus 3 enters the housing 101 via the opening 104 and is transported along the fourth sheet transport path R9.

In the housing 101, the end surface 100A provided with the opening 102 has a positioning hole 108.

Furthermore, the image forming apparatus 1 is provided with a first sheet feed device 410, a second sheet feed device 420, and a third sheet feed device 430 that feed sheets P to the first sheet transport path R1.

The first sheet feed device 410 to the third sheet feed device 430 have the same configuration. Each of the first sheet feed device 410 to the third sheet feed device 430 is provided with a sheet accommodation section 43 that accommodates sheets P, a fetching roller 42 that is provided above the sheet accommodation section 43 and at the downstream thereof in the transport direction of a sheet P (i.e., at the left side of the sheet accommodation section 43 in FIG. 2) and that fetches and transports a sheet P from the sheet accommodation section 43, and a housing moving mechanism 49 (which will be described in detail later) that moves a sheet P accommodated in the sheet accommodation section 43 in the depth direction.

The second sheet transport path R3 is provided with a fixing device 50 that fixes an image second-transferred on a sheet P by the second-transfer device 30 onto the sheet P. The fixing device 50 is provided with a heating belt 50A that is heated by a built-in heater (not shown) and a pressing roller 50B that presses the heating belt 50A. When the sheet P passes through a nip N where the heating belt 50A and the pressing roller 50B press against each other, the sheet P is pressed and heated, whereby the image on the sheet P becomes fixed onto the sheet P.

A transport device 51 that transports a sheet P that has passed through the second-transfer device 30 toward the fixing device 50 is provided between the second-transfer device 30 and the fixing device 50. The transport device 51 has a rotatable belt 51A and transports the sheet P while supporting the sheet P on this belt 51A.

A curl correcting device 52 that corrects bending (i.e., curling) of the sheet P having the image fixed thereon by the fixing device 50 is provided in the second sheet transport path R3. The curl correcting device 52 has two pairs of rollers in the second sheet transport path R3. Each pair includes a rigid roller 52A and an elastic roller 52B that drives the sheet P while pressing against the rigid roller 52A. With regard to the positional relationship between the two pairs of rigid rollers 52A and elastic rollers 52B disposed with the second sheet transport path R3 interposed therebetween, the two rollers in one pair and the two rollers in the other pair are disposed in an inverted configuration relative to the second sheet transport path R3.

Each of the image forming units 10 includes a rotatably-attached photoconductor drum 11. Each photoconductor drum 11 is surrounded by a charging device 12 that electrostatically charges the photoconductor drum 11, an exposure device 13 that exposes the photoconductor drum 11 to light so as to write an electrostatic latent image thereon, and a developing device 14 that develops the electrostatic latent image on the photoconductor drum 11 into a visible image by using toner. Moreover, each photoconductor drum 11 is provided with a first-transfer device 15 that transfers the toner image of the corresponding color component formed on the photoconductor drum 11 onto the intermediate transfer belt 20, and a drum cleaning device 16 that removes residual toner from the photoconductor drum 11.

The intermediate transfer belt 20 is wrapped around three rollers 21 to 23 and is provided in a rotatable manner. Of these three rollers 21 to 23, the roller 22 is configured to drive the intermediate transfer belt 20. The roller 23 is disposed facing a second-transfer roller 31, which is located below the intermediate transfer belt 20, with the intermediate transfer belt 20 interposed therebetween. The second-transfer roller 31 and the roller 23 constitute the second-transfer device 30. A belt cleaning device 24 that removes residual toner from the intermediate transfer belt 20 is provided at a position where the belt cleaning device 24 faces the roller 21 with the intermediate transfer belt 20 interposed therebetween.

The first sheet transport path R1 as an example of a transport path has a curve portion C1 where the first sheet transport path R1 used for transporting a sheet P from any one of the first sheet feed device 410 to the third sheet feed device 430 in the image forming apparatus 1 curves toward the second-transfer device 30.

Sheet Feed Apparatus 3

Figure 3:
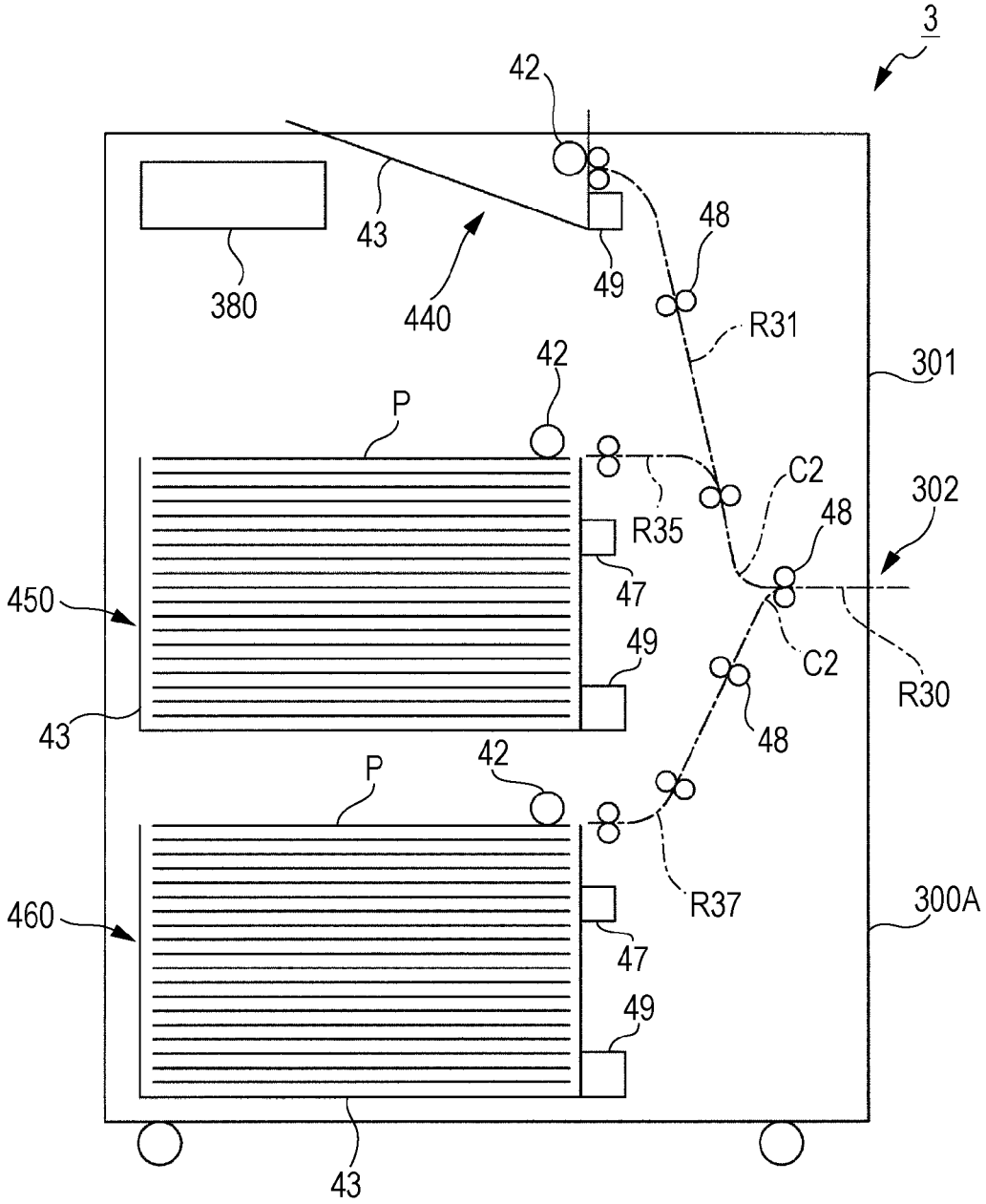
FIG. 3 illustrates the overall configuration of a sheet feed apparatus.

Next, the sheet feed apparatus 3 will be described with reference to FIG. 3. FIG. 3 illustrates the overall configuration of the sheet feed apparatus 3.

The sheet feed apparatus 3 shown in FIG. 3 is a so-called high-capacity feeder (HCF) and is capable of feeding a sheet P toward the image forming apparatus 1 at high speed. The sheet feed apparatus 3 is used as a so-called optional apparatus when performing an image forming operation on, for example, coated paper or thick paper so that the frequency of resupplying sheets P may be reduced.

The sheet feed apparatus 3 is provided with a first sheet feed path R30 used for transporting a sheet P toward the image forming apparatus 1, and a second sheet feed path R31, a third sheet feed path R35, and a fourth sheet feed path R37 that are connected to the first sheet feed path R30. The second sheet feed path R31 and the fourth sheet feed path R37 have second curve portions C2 where a sheet P transported from any one of a fourth sheet feed device 440 to a sixth sheet feed device 460 is curved toward the first sheet feed path R30.

The first sheet feed path R30 to the fourth sheet feed path R37 are provided with multiple transport rollers 48 that transport a sheet P.

Furthermore, the sheet feed apparatus 3 is provided with a feed controller 380 that is connected to the integrated controller 80 and that controls the operation of each device and each section constituting the sheet feed apparatus 3.

Moreover, the sheet feed apparatus 3 includes a housing 301. An end surface 300A of this housing 301 is provided with an opening 302. A sheet P transported along the first sheet feed path R30 is discharged toward the image forming apparatus 1 via the opening 302.

The sheet feed apparatus 3 is provided with the fourth sheet feed device 440, the fifth sheet feed device 450, and the sixth sheet feed device 460 that feed sheets P to the second sheet feed path R31, the third sheet feed path R35, and the fourth sheet feed path R37, respectively.

Each of the fourth sheet feed device 440 to the sixth sheet feed device 460 as an example of sheet load sections has a sheet accommodation section 43 that accommodates sheets P, a fetching roller 42 that is provided above the sheet accommodation section 43 and at the downstream thereof in the transport direction of a sheet P (i.e., at the right side of the sheet accommodation section 43 in FIG. 3) and that fetches and transports a sheet P from the sheet accommodation section 43, a blower 47 that blows air onto a side surface of the sheets P accommodated in the sheet accommodation section 43, and a housing moving mechanism 49 (which will be described in detail later) that moves the sheet accommodation section 43 in the depth direction.

In the example shown in FIG. 3, the sheet accommodation section 43 of the fourth sheet feed device 440 has an inclined section on which a sheet P is loaded. The sheet accommodation sections 43 of the fifth sheet feed device 450 and the sixth sheet feed device 460 each have a housing 435 (which will be described later with reference to FIG. 10) that accommodates sheets P therein. Alternatively, the sheet accommodation sections 43 may have different configurations. The fifth sheet feed device 450 and the sixth sheet feed device 460 are different from the first sheet feed device 410 to the third sheet feed device 430 in terms of the blowers 47 and the amount of sheets P accommodatable in the sheet accommodation sections 43 thereof, but have a configuration similar to the first sheet feed device 410 to the third sheet feed device 430.

Sheet Processing Apparatus 5

Figure 4:
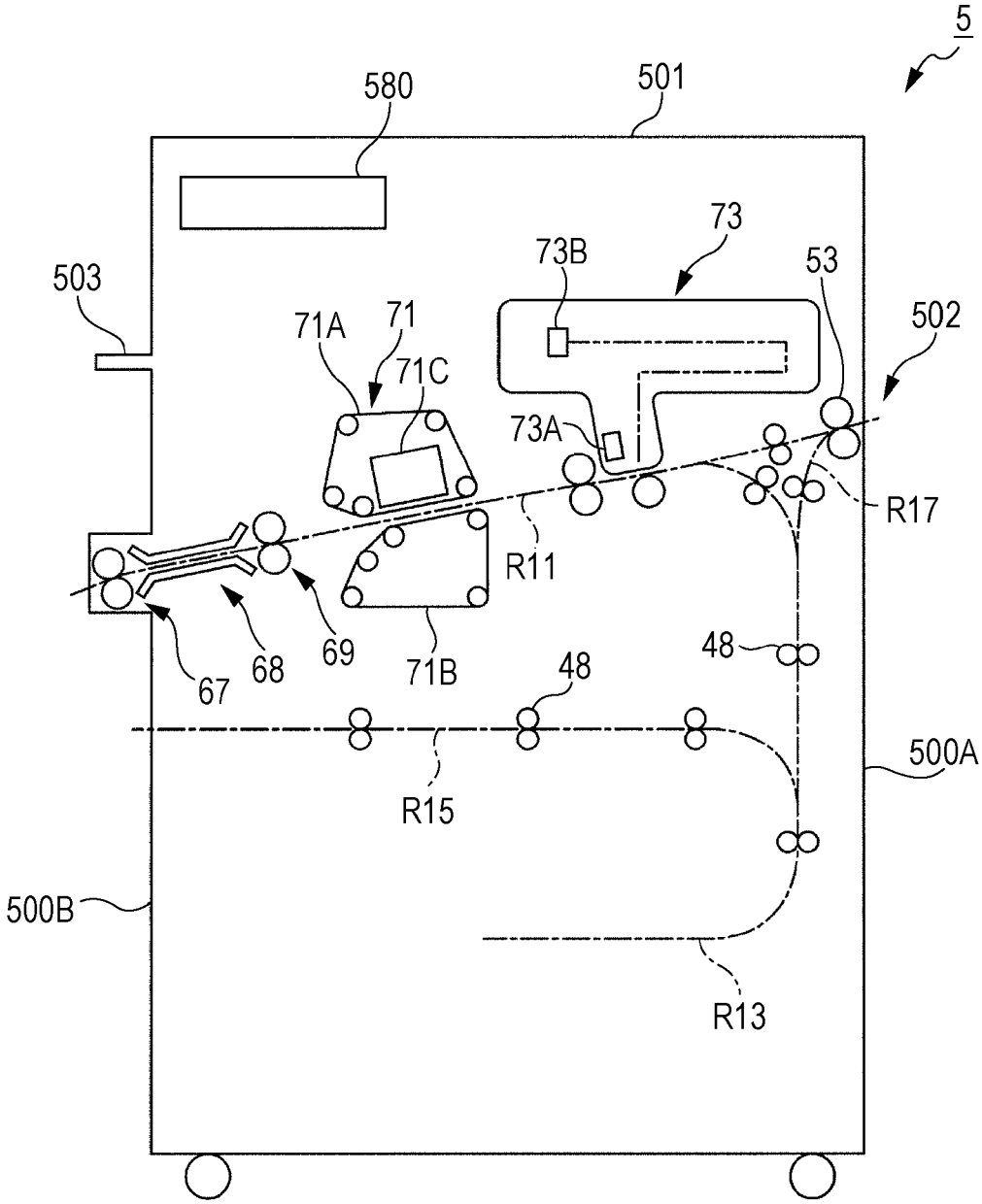
FIG. 4 illustrates the overall configuration of a sheet processing apparatus.

The sheet processing apparatus 5 will now be described with reference to FIG. 4. FIG. 4 illustrates the overall configuration of the sheet processing apparatus 5.

The sheet processing apparatus 5 is provided with a receiving roller 67 that receives a sheet P having an image fixed thereon by the fixing device 50 of the image forming apparatus 1, a movable transport roller 69 that further transports the sheet P received by the receiving roller 67, and a guide member (i.e., a so-called chute) 68 that is provided between the receiving roller 67 and the movable transport roller 69. The guide member 68 constitutes a part of an eighth sheet transport path R11 and guides the sheet P that has passed through the receiving roller 67 toward the movable transport roller 69.

The sheet processing apparatus 5 includes a cooling device 71 that cools the aforementioned toner images of the respective colors on the sheet P and facilitates the fixation of the toner images onto the sheet P, an in-line sensor 73 that optically detects, for example, density defects, image defects, and image-position defects in the toner images fixed on the sheet P, a discharge roller 53 that discharges the sheet P that has passed through the in-line sensor 73 outward from the sheet processing apparatus 5, and a processing controller 580 that is connected to the integrated controller 80 and that controls the operation of each device and each section constituting the sheet processing apparatus 5.

The sheet processing apparatus 5 is provided with the eighth sheet transport path R11 used for transporting a sheet P discharged from the image forming apparatus 1, an inversion transport path R13 that branches off from the eighth sheet transport path R11 at the downstream side of the in-line sensor 73, a re-transport path R15 that branches off from the inversion transport path R13 and connects to the third sheet transport path R7 in the image forming apparatus 1, and a ninth sheet transport path R17 that branches off from the inversion transport path R13 and connects to the eighth sheet transport path R11.

The eighth sheet transport path R11, the inversion transport path R13, the re-transport path R15, and the ninth sheet transport path R17 are provided with multiple transport rollers 48 that transport a sheet P.

The sheet processing apparatus 5 includes a housing 501. An end surface 500A of the housing 501 located opposite the image forming apparatus 1 is provided with an opening 502. A sheet P transported along the eighth sheet transport path R11 is discharged outside the housing 501 by the discharge roller 53 via the opening 502.

An end surface 500E of the housing 501 that faces the image forming apparatus 1 is provided with a positioning pin 503 at a position corresponding to the positioning hole 108 in the image forming apparatus 1. The positioning pin 503 protrudes outward from the housing 501. When connecting the sheet processing apparatus 5 to the image forming apparatus 1, the positioning pin 503 is inserted into the positioning hole 108 so that the sheet processing apparatus 5 is positionally set relative to the image forming apparatus 1.

The cooling device 71 includes transport belts 71A and 71B that transport a sheet P along the eighth sheet transport path R11 while nipping the sheet P from upper and lower sides thereof, a heat sink 71C that is formed of multiple fins and cools the transport belts 71A and 71B by receiving air sent from an externally-provided fan (not shown), and multiple tension rollers that rotate the transport belts 71A and 71B while applying tension thereto.

The heat sink 71C is in contact with the inner peripheral surface of the transport belt 71A so as to absorb heat from the transport belt 71A. Thus, the sheet P heated by the fixing device 50 is cooled, whereby the toner on the surface of the sheet P becomes fixed thereon while its smoothness is maintained.

The in-line sensor 73 includes a light source 73A formed of, for example, an incandescent lamp or a white-light emitting diode, and a light receiving element 73B formed of, for example, a charge coupled device (CCD).

The light receiving element 73B receives light radiated from the light source 73A and reflected by a sheet P traveling along the eighth sheet transport path R11. Based on the intensity of the received light, the light receiving element 73B outputs a signal to the integrated controller 80 of the image forming apparatus 1. Based on the signal from the in-line sensor 73, the integrated controller 80 corrects images to be formed at the image forming units 10. For example, the intensity of light radiated by the exposure devices 13 or an image formation position is corrected based on the signal from the in-line sensor 73.

In the sheet processing apparatus 5 according to this exemplary embodiment, a sheet P having an image formed on one face thereof may be switched back by the inversion transport path R13, where appropriate. Then, the switched-back sheet P whose leading edge and trailing edge in the transport direction thereof have been inverted is transported toward the ninth sheet transport path R17 or the re-transport path R15.

In a case where the sheet P is transported from the inversion transport path R13 toward the ninth sheet transport path R17, the sheet P, in an inverted state, is transported along the ninth sheet transport path R17 or the eighth sheet transport path R11 so as to be discharged outside the sheet processing apparatus 5.

On the other hand, in a case where the sheet P is transported from the inversion transport path R13 toward the re-transport path R15, the sheet P, in an inverted state, is transported again to the second-transfer device 30 via the third sheet transport path R7 or the first sheet transport path R1. Thus, an image is formed on the other face of the inverted sheet P at the second-transfer device 30. In other words, images are formed on both faces of the sheet P. The inversion transport path R13 may be considered as a switch-back path or a duplex printing path.

Operation of Image Forming System 100

Next, an image forming operation performed by the image forming system 100 according to this exemplary embodiment will be described with reference to FIGS. 1 to 4.

First, in the image forming system 100, the first sheet feed path R30 in the sheet feed apparatus 3 is connected to the fourth sheet transport path R9 in the image forming apparatus 1. Furthermore, the second sheet transport path R3 in the image forming apparatus 1 is connected to the eighth sheet transport path R11 in the sheet processing apparatus 5. Moreover, the third sheet transport path R7 in the image forming apparatus 1 is connected to the re-transport path R15 in the sheet processing apparatus 5.

The first sheet feed path R30 in the sheet feed apparatus 3, the fourth sheet transport path R9 in the image forming apparatus 1, and the downstream side of the curve portion C1 of the first sheet transport path R1 in the sheet transport direction extend substantially linearly in one direction (i.e., in the horizontal direction in the example shown in the drawings).

When image data created by the PC (not shown) is received by the integrated controller 80 of the image forming apparatus 1, the integrated controller 80 performs image processing on the image data. The image-processed image data is output to the exposure devices 13. Each exposure device 13 receiving the image data selectively exposes the corresponding photoconductor drum 11 electrostatically charged by the corresponding charging device 12 to light, thereby forming an electrostatic latent image on the photoconductor drum 11. The electrostatic latent image formed on the photoconductor drum 11 is developed into, for example, a black (K) toner image by the corresponding developing device 14.

In accordance with an image formation timing, a sheet P is fed to the first sheet transport path R1 from any one of the first sheet feed device 410 to the sixth sheet feed device 460 as an example of feed sections. This sheet P is transported toward the second-transfer device 30 in accordance with a rotation timing of the intermediate transfer belt 20. At the second-transfer device 30, the toner image formed on the photoconductor drum 11 is transferred onto the sheet P.

Subsequently, the sheet P having the toner image transferred thereon is transported along the second sheet transport path R3 and undergoes a fixing process at the fixing device 50. Then, the sheet P having the fixed image thereon undergoes a curl correction process at the curl correcting device 52. Subsequently, the sheet P that has passed through the curl correcting device 52 is discharged from the opening 102 provided in the housing 101.

The sheet P discharged from the opening 102 in the image forming apparatus 1 is cooled by the cooling device 71 while being transported along the eighth sheet transport path R11 in the sheet processing apparatus 5, and the in-line sensor 73 detects the toner image. Then, the sheet P is transported along the eighth sheet transport path R11 and is discharged from the opening 502 in the housing 501 so as to be loaded onto a sheet load section (not shown).

After each image forming unit 10 performs the image forming process and the toner image on each photoconductor drum 11 is transferred onto the sheet P, residual toner is sometimes adhered on the photoconductor drum 11. The residual toner on the photoconductor drum 11 is removed therefrom by the drum cleaning device 16. Likewise, residual toner on the intermediate transfer belt 20 is removed therefrom by the belt cleaning device 24.

When duplex printing is to be performed, the sheet P that has the fixed image formed on one face of the sheet P as a result of the above-described process and that has passed through the in-line sensor 73 is guided toward the inversion transport path R13 from the eighth sheet transport path R11. Then, the sheet P switched back by the inversion transport path R13 is transported again to the second-transfer device 30 via the re-transport path R15, the third sheet transport path R7, and the first sheet transport path R1.

The sheet P having a toner image formed on the other face thereof passes through the second-transfer device 30 and the curl correcting device 52 again. Then, the sheet P is discharged from the opening 102. The sheet P discharged from the opening 102 in the image forming apparatus 1 is transported along the eighth sheet transport path R11 in the sheet processing apparatus 5 and travels through the cooling device 71, the in-line sensor 73, and the opening 502 so as to be loaded onto the sheet load section (not shown).

Transport Position Adjuster 60

Figure 5:
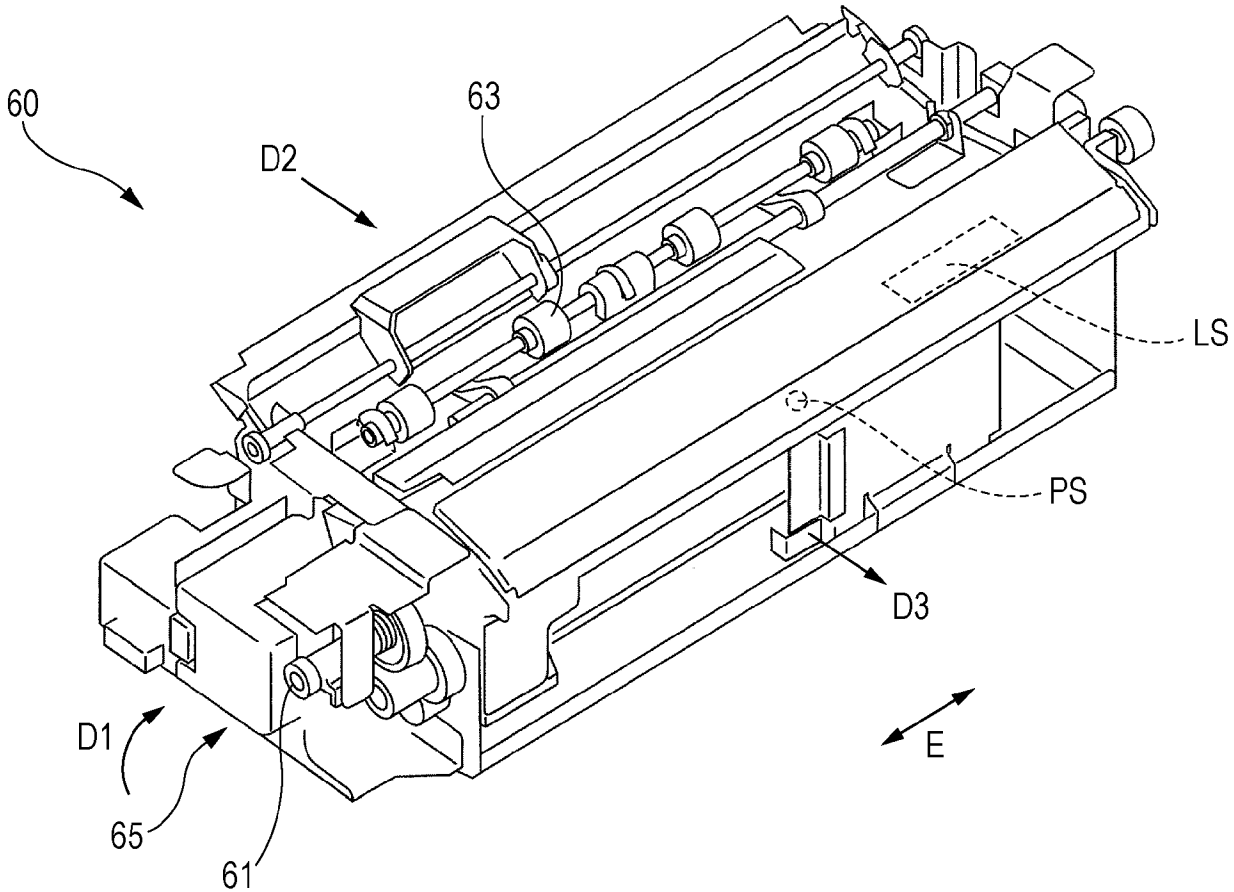
FIG. 5 is a perspective view of a transport position adjuster.
Figure 6A:
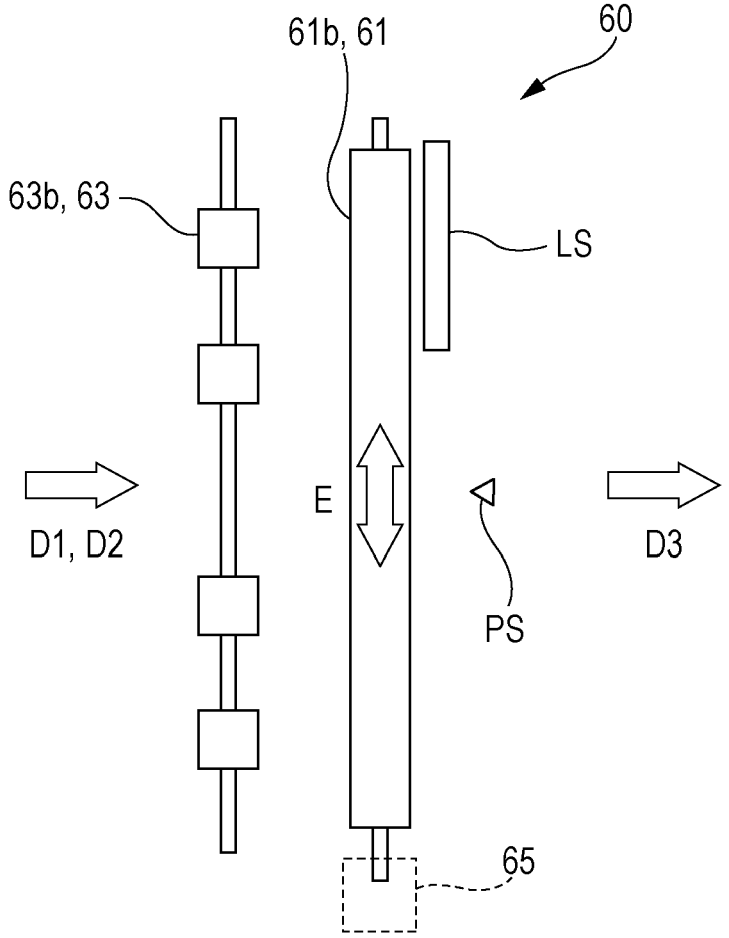
FIG. 6A is a top view of the transport position adjuster.
Figure 6B:
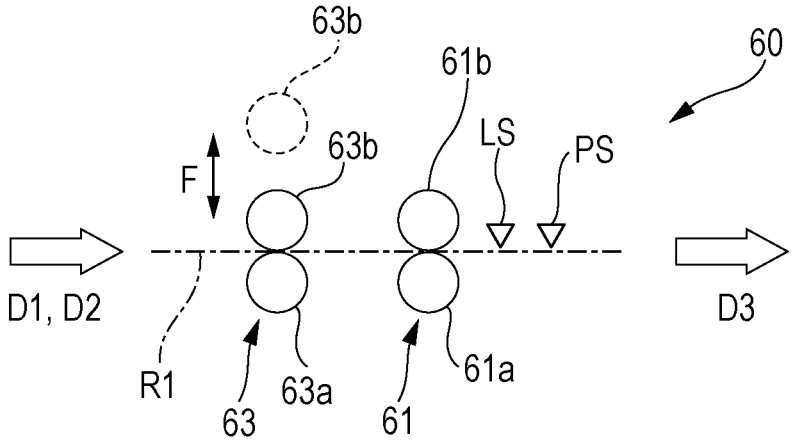
FIG. 6B is a side view of the transport position adjuster.
Figure 7:
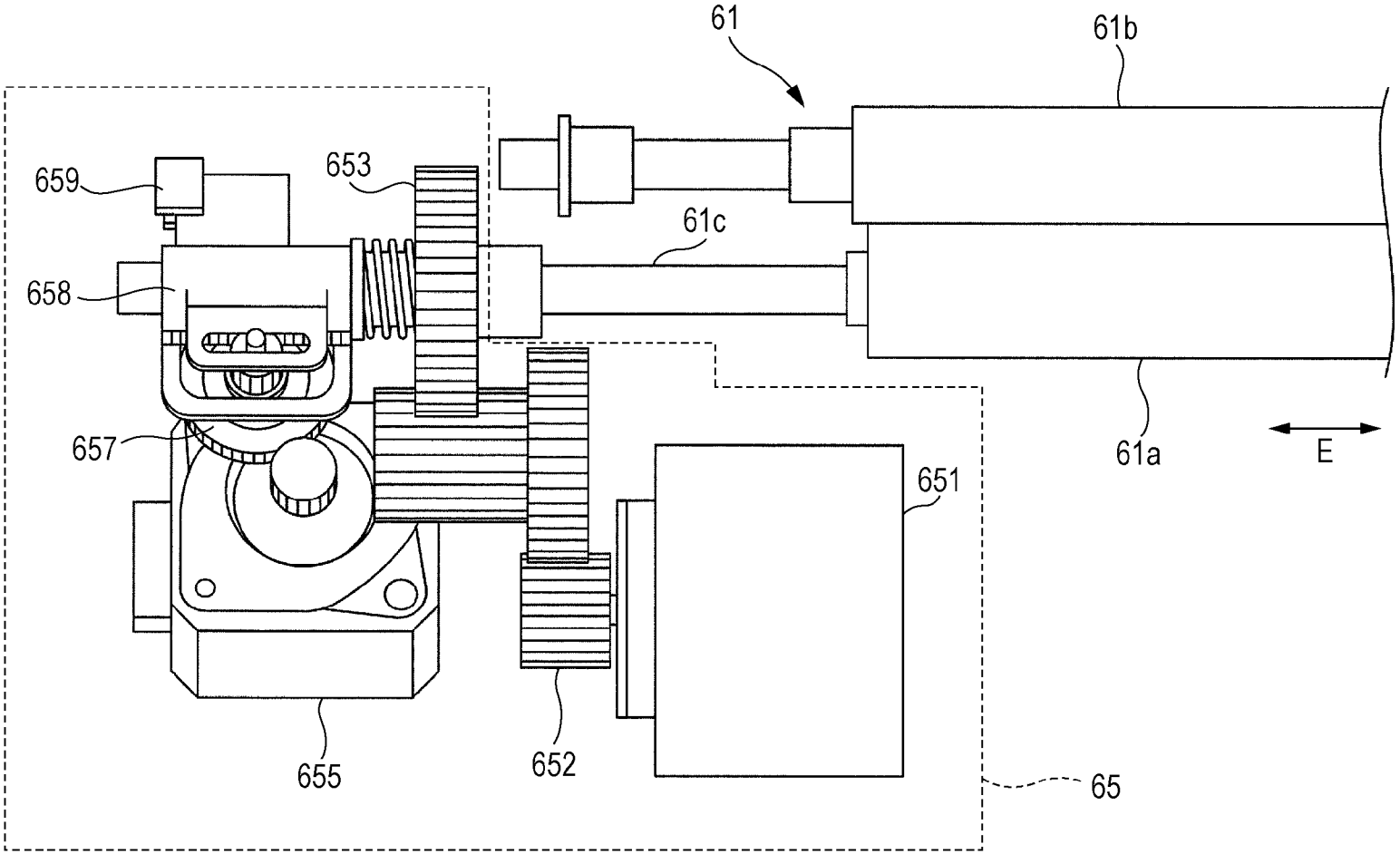
FIG. 7 schematically illustrates the configuration of a registration-roller driving mechanism.

Next, the configuration of the transport position adjuster 60 provided in the image forming apparatus 1 will be described with reference to FIGS. 5 to 7. FIG. 5 is a perspective view of the transport position adjuster 60. FIG. 6A is a top view of the transport position adjuster 60, and FIG. 6B is a side view of the transport position adjuster 60. With regard to the configuration of the transport position adjuster 60 shown in FIGS. 6A and 6B, some components have been omitted therefrom for simplification. FIG. 7 schematically illustrates the configuration of a registration-roller driving mechanism 65.

As shown in FIG. 5, the transport position adjuster 60 includes a registration roller 61 that transports a sheet P to the second-transfer device 30 in accordance with a moving timing of the intermediate transfer belt 20 having a toner image formed thereon, and a pre-registration roller 63 that is located upstream of the registration roller 61 in the first sheet transport path R1 and that transports the sheet P toward the registration roller 61.

The transport position adjuster 60 also includes the registration-roller driving mechanism 65 that drives the registration roller 61 and that changes the position of the registration roller 61 in the depth direction (see arrow E), a line sensor LS that is located downstream of the registration roller 61 in the first sheet transport path R1 and that detects an edge of the sheet P in the depth direction, and a passing sensor PS that is located downstream of the registration roller 61 in the first sheet transport path R1 and that detects the downstream edge (i.e., leading edge) of the sheet P in the transport direction thereof.

In the example shown in FIG. 5, the transport position adjuster 60 performs positional adjustment, in the depth direction (see arrow E), on a sheet P (see arrow D1) transported via the curve portion C1 of the first sheet transport path R1 or a sheet P (see arrow D2) transported along the fourth sheet transport path R9. Then, the transport position adjuster 60 transports this positionally-adjusted sheet P toward the second-transfer device 30 along the first sheet transport path R1 (see arrow D3).

Next, the configuration of the transport position adjuster 60 will be described in detail with reference to FIGS. 6A and 6B. As shown in FIGS. 6A and 6B, the registration roller 61 is constituted of a pair of rollers, which are a drive roller 61*a* and a driven roller 61*b*. The drive roller 61*a* and the driven roller 61*b* rotate while nipping a sheet P therebetween, thereby transporting the sheet P.

Furthermore, the registration roller 61 is connected to the registration-roller driving mechanism 65 at a front end of a rotation shaft 61*c* (see FIG. 7) of the drive roller 61*a*. The registration roller 61 is movable in the depth direction (see arrow E in FIG. 6A) by actuating the registration-roller driving mechanism 65.

The pre-registration roller 63 is constituted of a pair of rollers, which are a drive roller 63*a* and a driven roller 63*b*. The drive roller 63*a* and the driven roller 63*b* rotate while nipping a sheet P therebetween, thereby transporting the sheet P.

The pre-registration roller 63 includes a known separating mechanism (not shown) constituted of, for example, a motor and a cam. With regard to the pre-registration roller 63, the driven roller 63*b* is separable from the drive roller 63*a* (see arrow F in FIG. 6B) by this separating mechanism.

The configuration of the registration-roller driving mechanism 65 will now be described with reference to FIG. 7. As shown in FIG. 7, the registration-roller driving mechanism 65 includes a drive motor 651 that supplies driving force, a gear group 652 that transmits the driving force from the drive motor 651, and a drive gear 653 that is fixed to the rotation shaft 61*c* of the drive roller 61*a* and that rotates together with the rotation shaft 61*c* of the drive roller 61*a* by receiving the driving force from the gear group 652. The registration-roller driving mechanism 65 also includes a side shift motor 655 that supplies driving force, a pinion gear group 657 that rotates by receiving the driving force from the side shift motor 655, a rack gear 658 that is provided at the rotation shaft 61*c* of the drive roller 61*a* and that moves by receiving the driving force from the pinion gear group 657, and a home sensor 659 that detects the position of the drive roller 61*a* in the depth direction.

The registration-roller driving mechanism 65 transmits the driving force of the drive motor 651 to the rotation shaft 61*c* via the gear group 652 and the drive gear 653 so as to rotate the drive roller 61*a*.

Furthermore, the registration-roller driving mechanism 65 transmits the driving force of the side shift motor 655 via the pinion gear group 657 and the rack gear 658 so as to shift the drive roller 61*a* in the depth direction (side-shifting, see arrow E). The driven roller 61*b* is supported by a bearing (not shown) so as to be shiftable in the depth direction, and moves in the depth direction together with the drive roller 61*a* receiving the driving force of the drive motor 651.

Figure 8A:
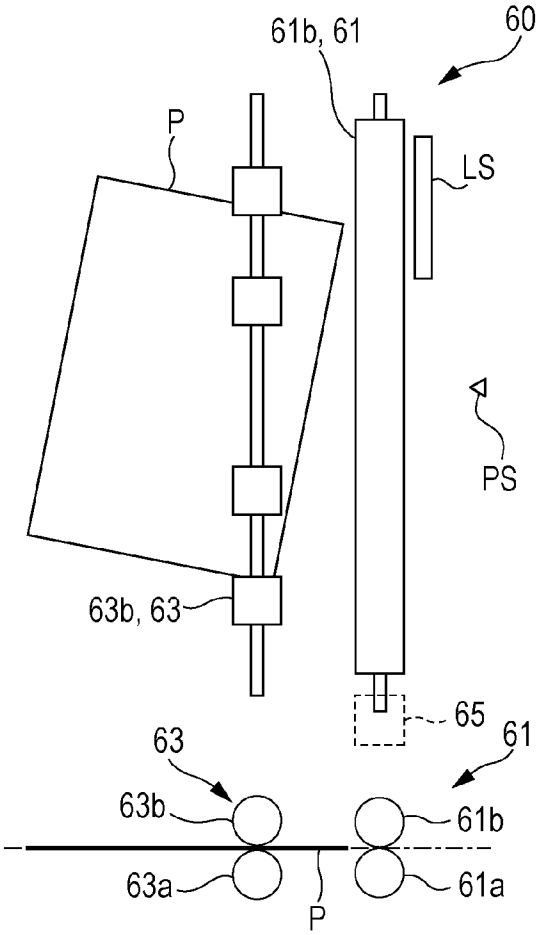
FIGS. 8A to 8C illustrate a position adjusting operation performed by the transport position adjuster.
Figure 8B:
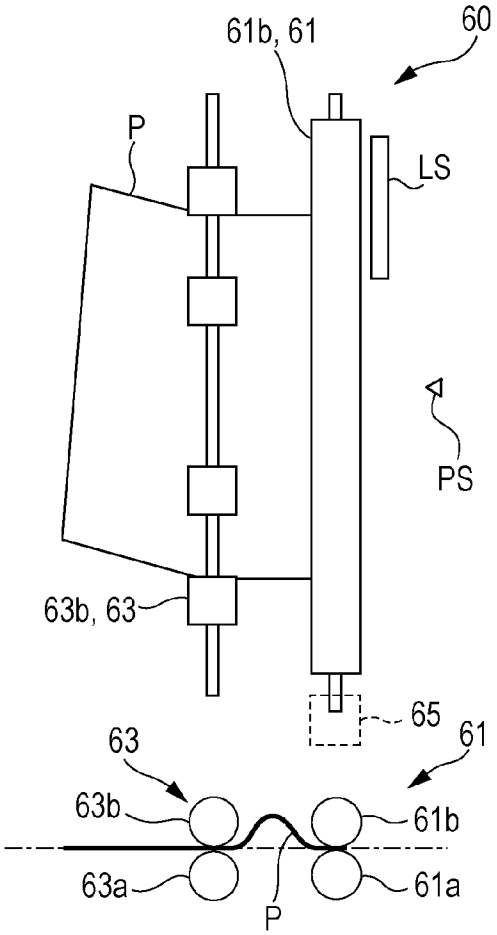
Figure 8C:
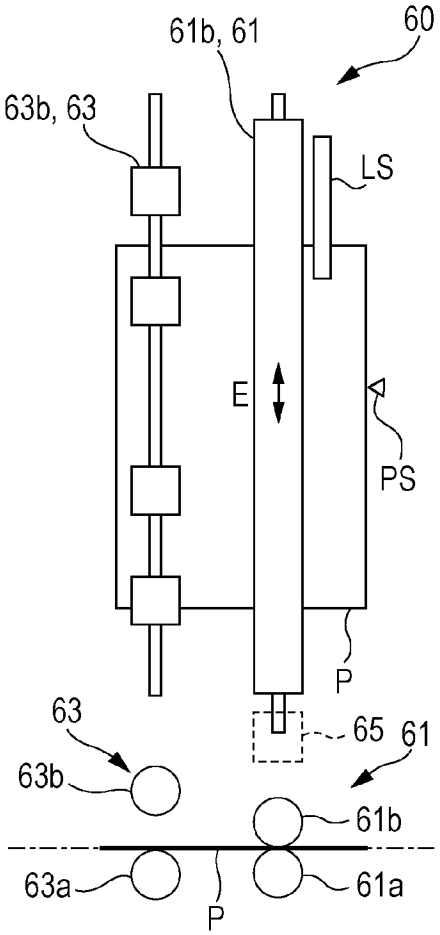

Next, a position adjusting operation performed by the transport position adjuster 60 will be described with reference to FIGS. 8A to 8C. FIGS. 8A to 8C illustrate the position adjusting operation performed by the transport position adjuster 60. In each of FIGS. 8A to 8C, the upper part is a top view of the transport position adjuster 60, and the lower part is a side view of the transport position adjuster 60.

First, when the image forming system 100 is installed, the positions of the first sheet feed device 410 to the sixth sheet feed device 460 are adjusted in accordance with the positions of images to be formed by the image forming units 10. However, a variation in the position of a sheet P in the depth direction (i.e., side registration position) may occur or the sheet P may become skewed. Such a positional variation or skew may be occur, for example, when the sheet P fed from any one of the first sheet feed device 410 to the sixth sheet feed device 460 is transported along, for example, the first sheet transport path R1, if sheets P are disorderly arranged in the sheet accommodation sections 43, if sheets P are unevenly cut, and so on. In particular, in the configuration having the curve portions C1 and C2 in the transport paths of a sheet P as shown in the drawings, the magnitude of transport resistance received by the sheet P when passing through the curve portions C1 and C2 varies between when thick paper is transported and when thin paper is transported, resulting in a variation in side registration positions.

In this exemplary embodiment, skew and a side registration position of a sheet P are corrected by the transport position adjuster 60. The operation of the transport position adjuster 60 will be described in detail below.

First, as shown in FIG. 8A, when a sheet P is transported toward the transport position adjuster 60, the driven roller 63*b* is in contact with the drive roller 63*a* in the pre-registration roller 63, and the registration roller 61 is stopped.

Subsequently, as shown in FIG. 8A, the sheet P transported from upstream is received by the pre-registration roller 63 and is further transported toward the registration roller 61.

Then, as shown in FIG. 8B, the leading edge of the sheet P transported by the pre-registration roller 63 abuts onto the registration roller 61, which is in a stopped state, so that the sheet P becomes looped (i.e., bent), whereby skew of the sheet P is corrected.

Subsequently, as shown in FIG. 8C, the registration roller 61 begins to rotate so that the skew-corrected sheet P becomes nipped by the registration roller 61. Then, when the registration roller 61 nips the sheet P, the driven roller 63*b* of the pre-registration roller 63 separates from the drive roller 63*a*. The registration roller 61 adjusts the side registration position of the sheet P while moving in the depth direction (see arrow E in FIG. 8C) in accordance with the position of an edge of the sheet P detected by the line sensor LS. While the passing sensor PS detects the edge (i.e., leading edge) of the sheet P, the registration roller 61 rotates in accordance with a moving timing of the intermediate transfer belt 20 having a toner image formed thereon, whereby the sheet P is transported toward the second-transfer device 30.

The transport position adjuster 60 operates in the above-described manner so that the position of the sheet P to be transported toward the second-transfer device 30 is adjusted, whereby the sheet P may be positionally aligned with the image to be transferred thereto at the second-transfer device 30. Furthermore, when images are to be formed on both faces of the sheet P, the images to be formed on the front face and the back face of the sheet P may be positionally aligned with each other.

Fifth Sheet Feed Device 450

Figure 9:
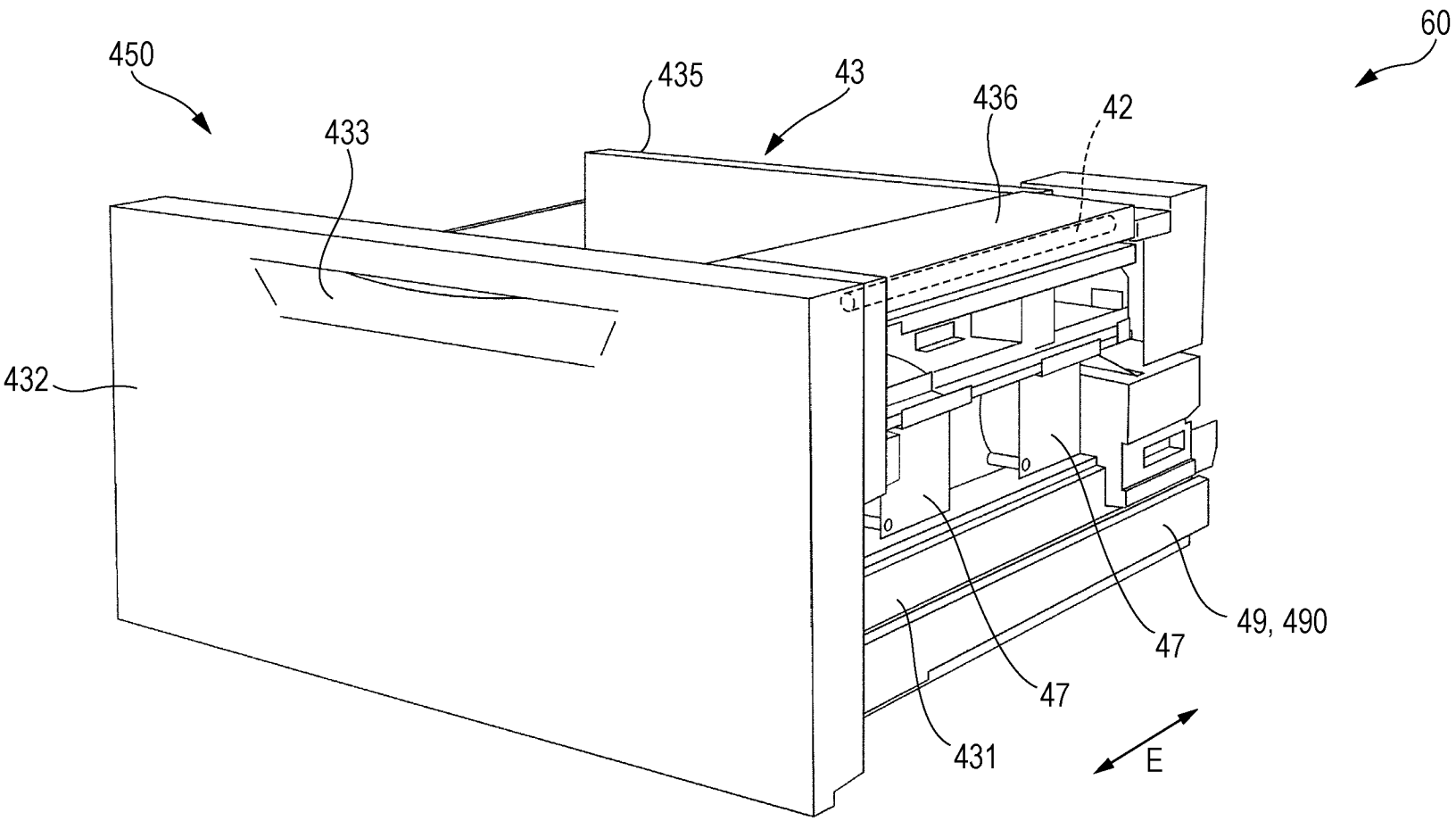
FIG. 9 is a perspective view of a fifth sheet feed device.
Figure 10:
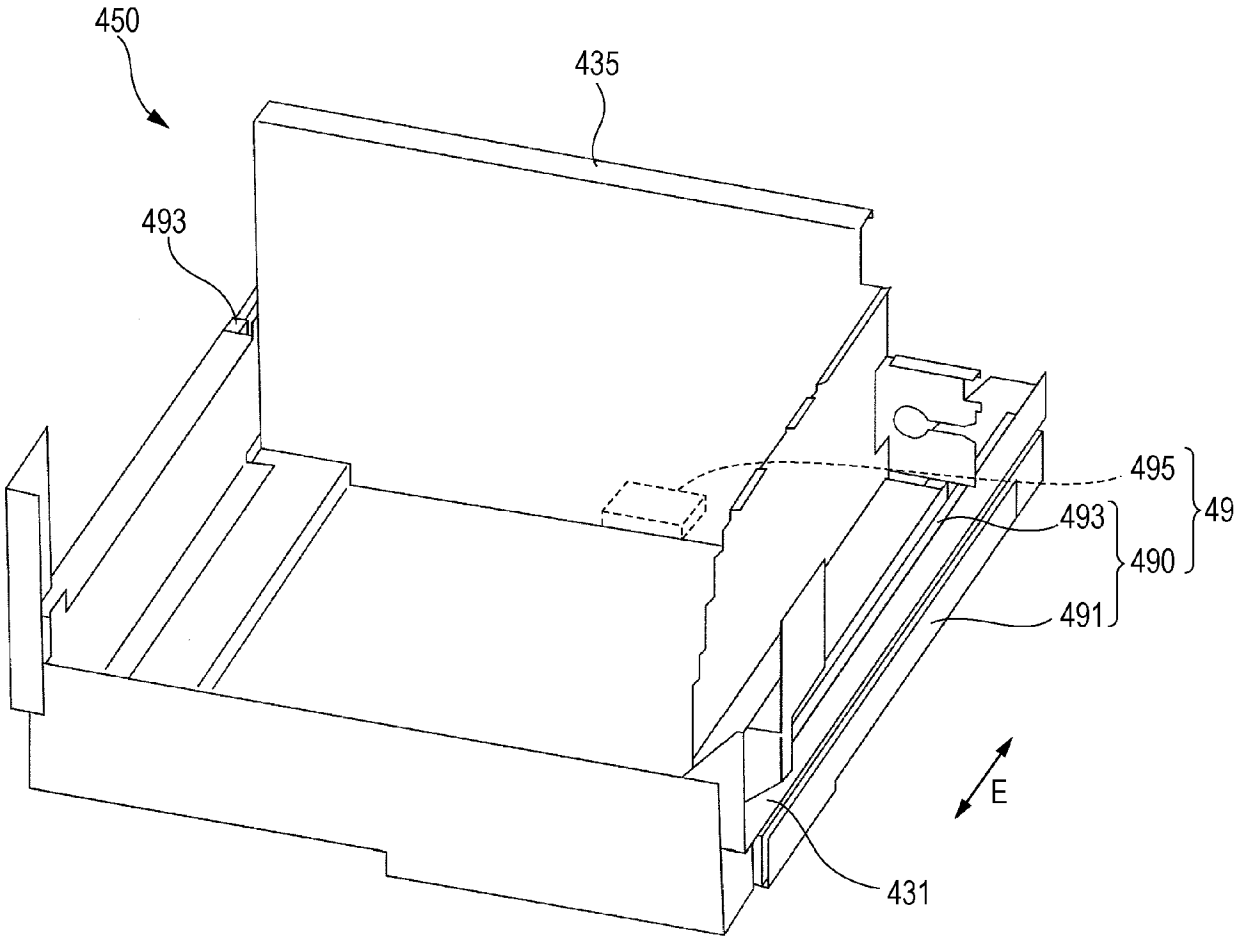
FIG. 10 schematically illustrates the configuration of a housing moving mechanism.
Figure 11:
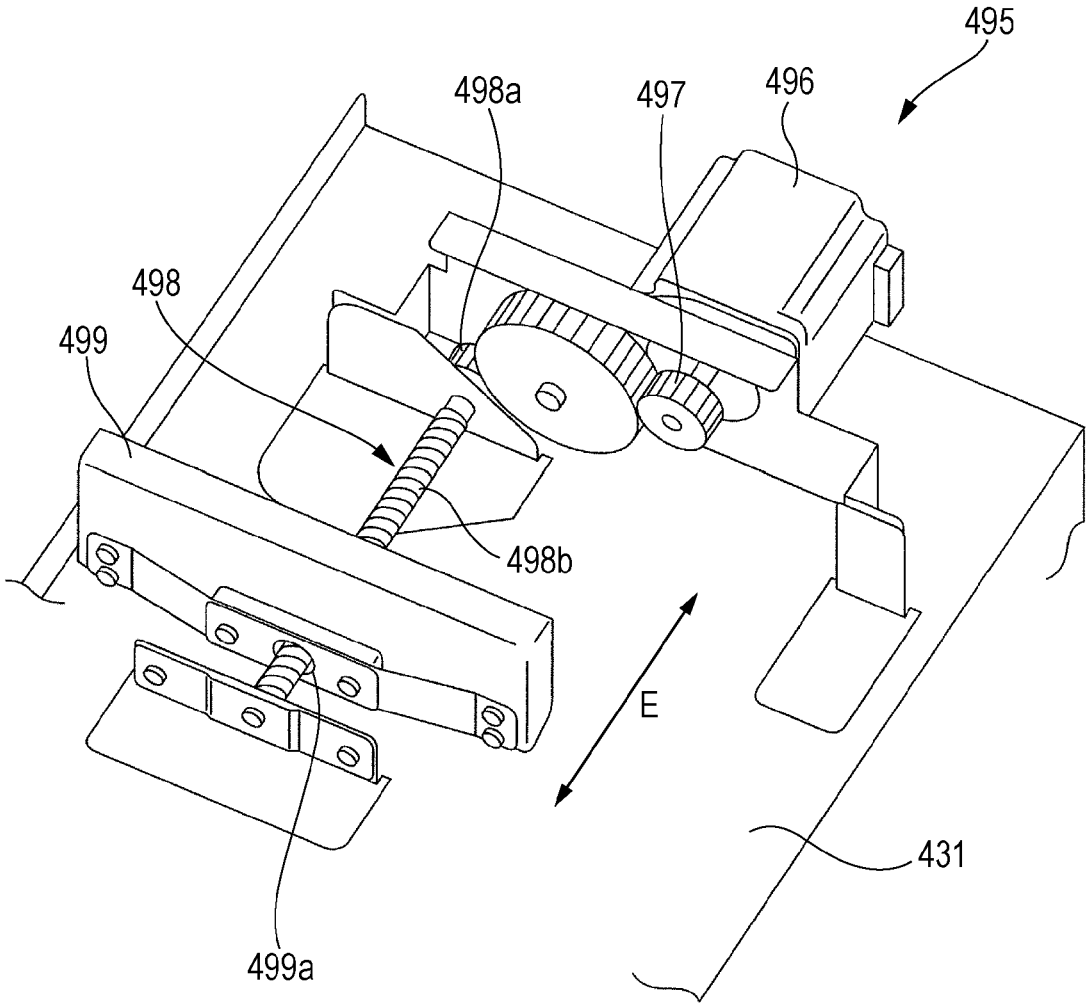
FIG. 11 schematically illustrates the configuration of a driver.

Next, the configuration of the fifth sheet feed device 450 provided in the sheet feed apparatus 3 will be described with reference to FIGS. 9 to 11. FIG. 9 is a perspective view of the fifth sheet feed device 450. FIG. 10 schematically illustrates the configuration of the housing moving mechanism 49. FIG. 11 schematically illustrates the configuration of a driver 495.

As described above, the fifth sheet feed device 450 shown in FIG. 9 includes the fetching roller 42, the sheet accommodation section 43, the blower 47, and the housing moving mechanism 49.

The sheet accommodation section 43 includes a base 431, a first cover member 432, the aforementioned housing 435, and a second cover member 436. The first cover member 432 is provided at the base 431, covers a side surface of the sheet accommodation section 43 facing the front side, and has a handle 433. The housing 435 accommodates sheets P therein, is provided above the base 431, and is movable in the depth direction relative to the base 431. The second cover member 436 is provided at the housing 435 and has the fetching roller 42 disposed therein.

As shown in FIG. 10, the housing moving mechanism 49 includes a support rail 490 extending in the depth direction, and the aforementioned driver 495 that moves the housing 435 relative to the base 431.

The support rail 490 includes an accommodation-section-ejecting rail 491 that is fixed to the base 431 so as to extend in the depth direction, and a housing-moving rail 493 that is fixed to the housing 435 so as to extend in the depth direction. The accommodation-section ejecting rail 491 is guided by an apparatus-side guide (not shown) provided at the sheet feed apparatus 3. The housing-moving rail 493 is guided by a base-side guide (not shown) provided at the base 431.

Furthermore, as shown in FIG. 11, the driver 495 includes a housing-moving motor 496, a gear group 497, a ball screw 498, a driving block 499, and a home sensor (not shown). The housing-moving motor 496 supplies driving force. The gear group 497 transmits the driving force from the housing-moving motor 496. The ball screw 498 is disposed such that its axial direction extends in the depth direction, and includes a gear 498*a* that meshes with the gear group 497 and an external thread 498*b* that is formed around an outer peripheral surface of the ball screw 498. The driving block 499 has a through-hole 499*a* through which the ball screw 498 extends, and also has an internal thread (not shown) that is formed in an inner peripheral surface of the through-hole 499*a* and that meshes with the external thread 498*b* of the ball screw 498. The home sensor detects the position of the driving block 499 in the depth direction. With regard to the driver 495 in the example shown in FIG. 11, the position thereof relative to the base 431 is fixed except for the driving block 499. The driving block 499 is movable relative to the base 431 and is fixed relative to the housing 435.

The sheet accommodation section 43 having the above-described configuration may be operated while the handle 433 is held. The accommodation-section ejecting rail 491 is guided by the apparatus-side guide (not shown) so that the sheet accommodation section 43 is movable in the depth direction (see arrow E), that is, the sheet accommodation section 43 is ejectable from the sheet feed apparatus 3 or insertable into the sheet feed apparatus 3.

Furthermore, in the driver 495, the driving force of the housing-moving motor 496 is transmitted via the gear group 497 and the ball screw 498 so that the driving block 499 that is fixed relative to the housing 435 is shifted in the depth direction. Accordingly, the housing 435 in which the driving block 499 is fixed positionally moves in the depth direction relative to the base 431 (see arrow E in FIG. 11). Then, due to the housing 435 positionally moving in the depth direction, the sheets P accommodated within the housing 435 positionally move in the depth direction. Thus, for example, even when the size of sheets P accommodated in the housing 435 is changed to another size, the position, in the depth direction, of sheets P fed from the fifth sheet feed device 450 may be kept constant by driving the driver 495.

Although the above description is directed to the fifth sheet feed device 450, each of the first sheet feed device 410 to the sixth sheet feed device 460 is also equipped with the aforementioned housing moving mechanism 49 and is capable of moving the position of sheets P in the depth direction.

Integrated Controller 80

Figure 12:
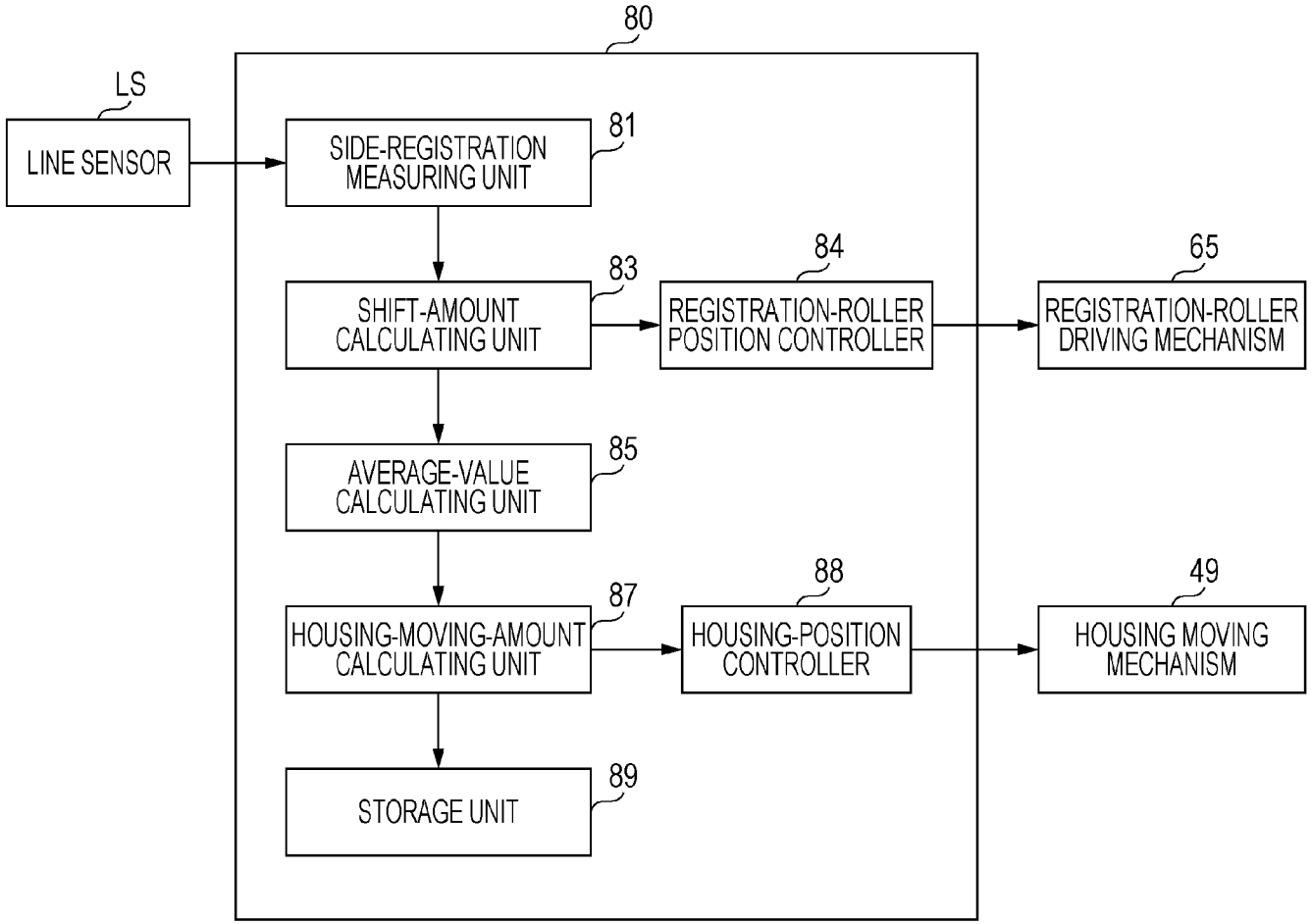
FIG. 12 illustrates a functional configuration of an integrated controller.

Next, the integrated controller 80 will be described with reference to FIG. 12. FIG. 12 schematically illustrates a functional configuration of the integrated controller 80.

The integrated controller 80 as an example of a load-position moving unit and a load-position controller is realized by, for example, a processor that achieves its function by being controlled by a program, a nonvolatile memory that stores the program for controlling the processor, and a volatile memory used for, for example, data processing by the processor.

The integrated controller 80 includes a side-registration measuring unit 81 that measures a side registration position of a sheet P based on a detection signal from the line sensor LS, a shift-amount calculating unit 83 that calculates a distance (i.e., shift amount) by which side-shifting of the registration roller 61 is to be performed based on the side registration position measured by the side-registration measuring unit 81, an average-value calculating unit 85 that calculates an average value of the shift amount calculated by the shift-amount calculating unit 83, a storage unit 89 that stores a threshold value (which will be described later) therein, and a housing-moving-amount calculating unit 87 that calculates a housing moving amount by which the housing 435 is to be moved by the housing moving mechanism 49 based on the average shift-amount value calculated by the average-value calculating unit 85 and the threshold value stored in the storage unit 89. Furthermore, the integrated controller 80 also includes a registration-roller position controller 84 that controls the registration-roller driving mechanism 65 based on the shift amount calculated by the shift-amount calculating unit 83, and a housing-position controller 88 that controls the housing moving mechanism 49 based on the housing moving amount calculated by the housing-moving-amount calculating unit 87.

Skew Caused By Side-Shifting

Figure 13A:
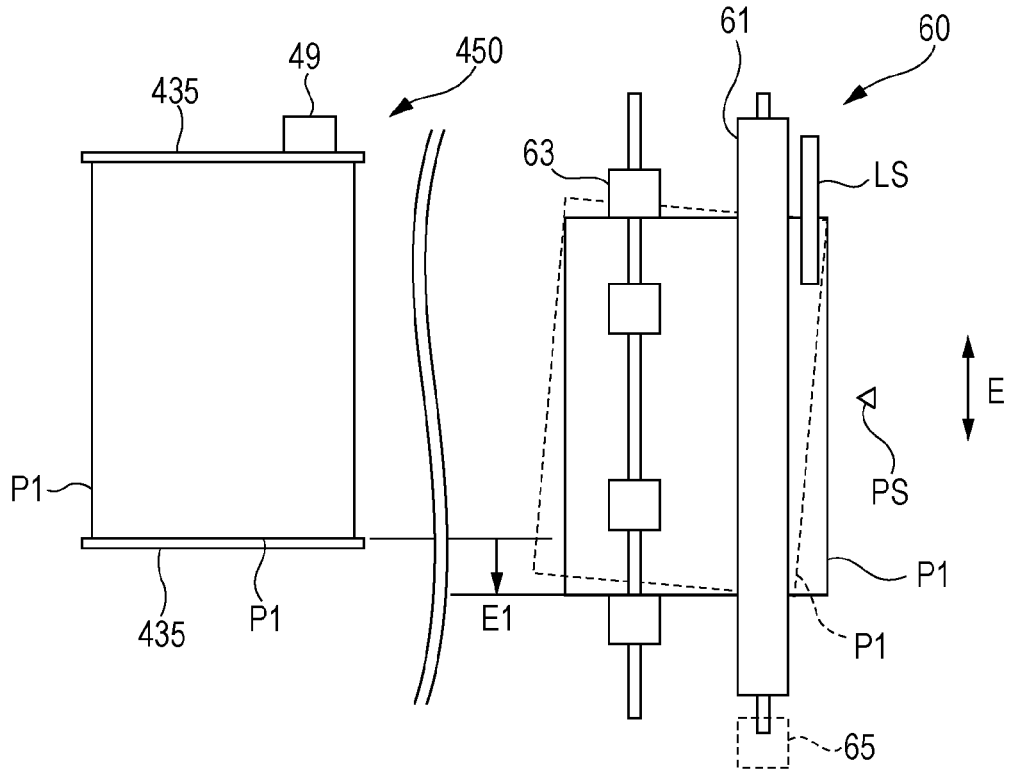
FIG. 13A illustrates skew caused by side-shifting.
Figure 13B:
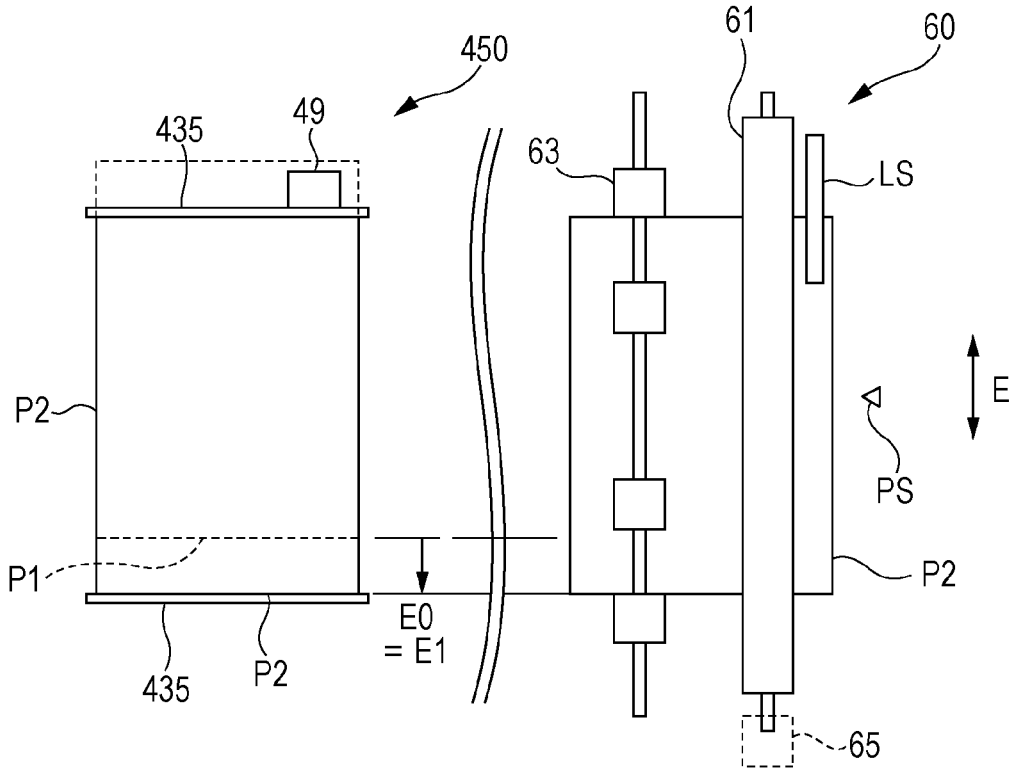
FIG. 13B illustrates an operation performed for suppressing skew caused by side-shifting, in accordance with this exemplary embodiment.

FIG. 13A illustrates skew caused by side-shifting, and FIG. 13B illustrates an operation performed for suppressing skew caused by side-shifting, in accordance with this exemplary embodiment.

As shown in FIG. 13A, when the registration roller 61 adjusts the side registration position of a sheet P1 fed from the fifth sheet feed device 450, if the shift amount for side-shifting (see arrow E1) increases, the sheet P1 may become skewed (see sheet P1 indicated by a dashed line).

More specifically, in the example shown in FIG. 13A, the housing moving mechanism 49 of the fifth sheet feed device 450 sets the housing 435 at a home position. Then, when side-shifting of the registration roller 61 is performed relative to a sheet P fed from the housing 435, only the leading edge of the sheet P in the transport direction thereof is held by the registration roller 61.

On the other hand, the trailing edge of the sheet P is not held by the registration roller 61 and is in contact with the drive roller 63*a* (not shown in FIGS. 13A and 13B) of the pre-registration roller 63 and the transport roller 48 located further upstream of the pre-registration roller 63, or with the chute (not shown) serving as the guide member that constitutes the first sheet transport path R1. Therefore, the trailing edge of the sheet P receives transport resistance from these components as the side-shifting of the registration roller 61 is performed. In particular, in the example shown in the drawings, the first sheet transport path R1 has the curve portion C1. In a case where the sheet P is thick paper or has a large size, if the side-shifting is performed in a state where the trailing edge of the sheet P is disposed in the curve portion C1, the transport resistance received by the trailing edge of the sheet P becomes larger.

When the side-shifting of the registration roller 61 is performed in the state where the trailing edge of the sheet P receives transport resistance, the sheet P may become slanted relative to the sheet transport direction. In other words, skew may occur. In the example shown in the drawings, a functional component that corrects skew of the sheet P is not provided between the registration roller 61 and the second-transfer device 30. Therefore, skew of the sheet P occurring at the registration roller 61 directly leads to the occurrence of misregistration of an image position on the sheet P.

Conceivable measures for alleviating the aforementioned skew include a configuration that releases not only the nip of the pre-registration roller 63 but also the nip of the transport roller 48 located upstream of the pre-registration roller 63 when performing the side-shifting or a configuration in which an area in the first sheet transport path R1 where the transport position adjuster 60 is provided is made horizontal so that friction between the sheet P and the chute (not shown) is reduced.

However, in order to release the nip of the transport roller 48, a nip-releasing mechanism has to be additionally provided, thus leading to an increase in cost. Furthermore, in order to design the first sheet transport path R1 so as to make it substantially horizontal, the dimensions of the image forming system 100 have to be increased.

Moreover, as mentioned above, the side registration position may greatly vary from job to job (i.e., a series of image forming operations performed based on a group of image data) or the side registration position of a sheet may change within a single job if sheets P are disorderly arranged in the sheet accommodation sections 43, if sheets P are unevenly cut, and so on, thus causing the shift amount to temporarily increase. If the shift amount temporarily increases in this manner, the aforementioned skew readily occurs. In other words, when the image forming system 100 is installed, the aforementioned skew may occur if the positions of the first sheet feed device 410 to the sixth sheet feed device 460 are simply adjusted in accordance with the image positions.

In this exemplary embodiment, the shift amount for adjusting the side registration position of a sheet P by the registration roller 61 is detected, and when this shift amount increases, the position of a sheet P, in the depth direction, fed from one of the first sheet feed device 410 to the sixth sheet feed device 460 is adjusted in advance.

Specifically, as shown in FIG. 13B, the housing moving mechanism 49 in the fifth sheet feed device 450 moves the housing 435 in a direction for reducing the shift amount of the registration roller 61. For example, if side-shifting of the registration roller 61 is to be performed by a distance E1 toward the front side (i.e., the lower side in FIG. 13A), as in the example shown in FIG. 13A, the housing 435 is moved in the depth direction by a distance E0 (=E1) in the direction for reducing the shift amount of the registration roller 61 (i.e., toward the front side in the example shown in FIG. 13B) from the home position.

Consequently, the shift amount of the registration roller 61 is minimized (i.e., the shift amount is zero in the example shown in FIG. 13B) so that the occurrence of skew caused by side-shifting of a sheet P2 by the registration roller 61 may be suppressed. Although the moving amount of the housing 435 is equal to the shift amount E1 shown in FIG. 13A for simplification, the moving amount of the housing 435 is defined as a distance that is equal to the average shift-amount value, which will be described later.

Figure 14:
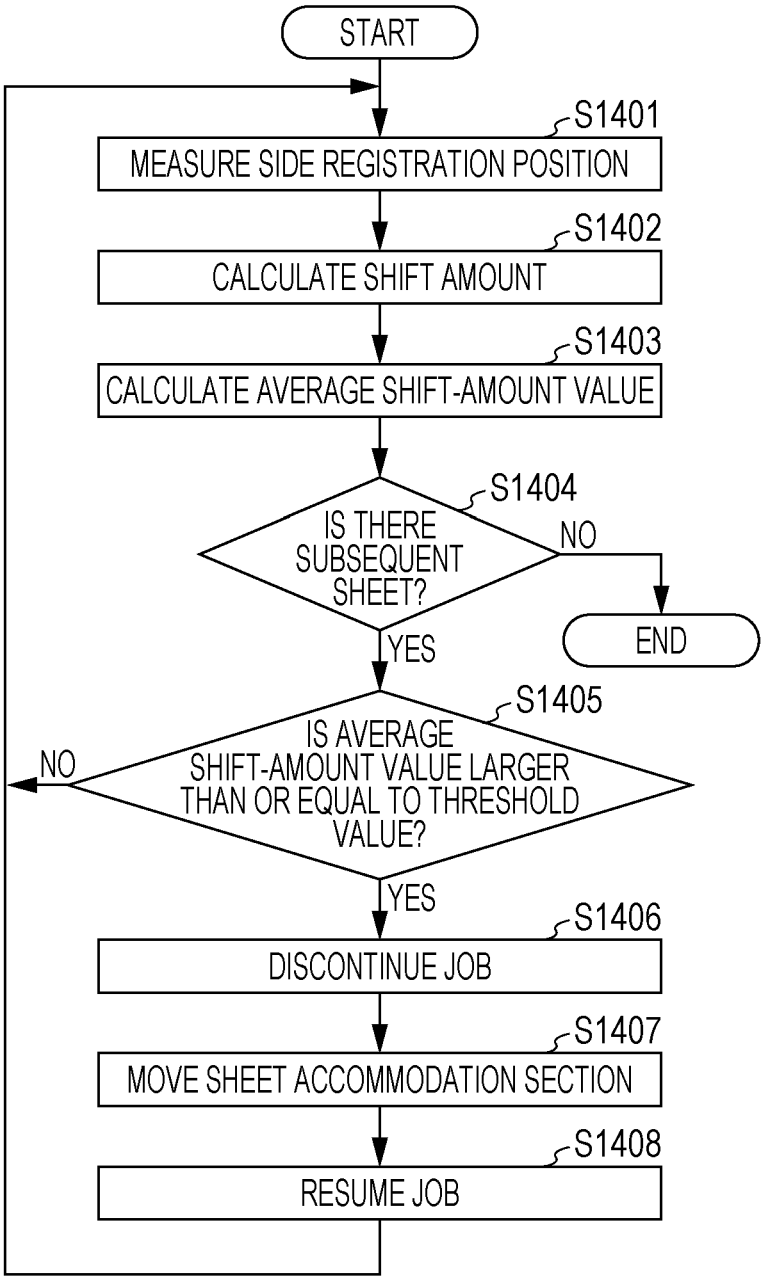
FIG. 14 is a flowchart illustrating the operation of the integrated controller.

Next, the operation of the integrated controller 80 will be described in detail. FIG. 14 is a flowchart illustrating the operation of the integrated controller 80.

First, in step S1401, the integrated controller 80 measures (detects) a side registration position of a sheet P based on a detection signal from the line sensor LS. Then, the integrated controller 80 calculates a shift amount of the registration roller 61 in step S1402 based on the measured side registration position, and calculates an average shift-amount value in step S1403. In step S1404, the integrated controller 80 determines whether or not there is a subsequently-fed sheet P (i.e., a subsequent sheet) in the currently-executed job.

If there is a subsequent sheet (YES in step S1404), the integrated controller 80 compares the threshold value stored in the storage unit 89 with the average shift-amount value in step S1405. If the average shift-amount value is larger than or equal to the threshold value (YES in step S1405), the integrated controller 80 discontinues the job, that is, temporarily stops a series of image forming operations performed based on a group of image data, in step S1406.

In step S1407, the housing 435 is moved by the housing moving mechanism 49 in the direction for reducing the shift amount of the registration roller 61. The moving amount of the housing 435 in this example is set equal to the average shift-amount value. After the housing 435 is completely moved, the job is resumed in step S1408. Then, the side registration position of the subsequent sheet P fed from the moved housing 435 is measured in step S1401.

On the other hand, if the average shift-amount value is smaller than the threshold value (NO in step S1405), the side registration position of the subsequent sheet P is measured in step S1401 without moving the housing 435.

Furthermore, if the determination result in step S1404 indicates that there is no subsequent sheet (NO in step S1404), the job ends.

By discontinuing the job for which the image forming operation is executed, the number of skewed sheets P may be more reliably minimized.

The position of the housing 435 positionally adjusted by discontinuing the job is maintained for subsequent jobs.

If the sheet accommodation section 43 is operated (i.e., ejected and inserted) for resupplying new sheets P, changing the type of sheets P, and so on, the position of the sheet accommodation section 43 is returned to the position (i.e., home position) prior to the adjustment. This is because the position of the sheets P may possibly be changed. Although not described above, a sensor (not shown) that detects an operation performed on the sheet accommodation section 43 is provided, and an input from this sensor is received by the integrated controller 80. When the integrated controller 80 receives the input from this sensor, the integrated controller 80 performs an operation that causes the housing moving mechanism 49 to move the housing 435 in the depth direction so as to return the housing 435 to the home position in a job to be executed after the input reception.

Accordingly, skew of a sheet P caused by side-shifting of the registration roller 61 may be suppressed, so that alignment performance between the images formed by the image forming units 10 and the sheet P may be improved. This alignment performance is further improved especially in a case where the sheet P is so-called thick paper.

Furthermore, the effect of transport resistance received by the sheet P, due to side-shifting of the registration roller 61, from the pre-registration roller 63 and the transport roller 48 that are located upstream of the registration roller 61 in the transport direction or from the chute (not shown) that constitutes the first sheet transport path R1 may be minimized. Therefore, for example, even with the first sheet transport path R1 being curved due to having the curve portion C1, skew of the sheet P caused by side-shifting of the registration roller 61 may be suppressed. Specifically, the curved configuration of the first sheet transport path R1 is permitted, thereby increasing the degree of freedom in terms of layout. Moreover, the dimensions of the image forming system 100 may be minimized, as compared with a case where the first sheet transport path R1 is designed as a so-called straight path that is substantially horizontal.

In this exemplary embodiment described above, the integrated controller 80 moves the housing 435 if the average shift-amount value is larger than or equal to the threshold value, and does not move the housing 435 if the average shift-amount value is smaller than the threshold value. Specifically, the integrated controller 80 according to this exemplary embodiment is configured to execute side-shifting of the registration roller 61 if the shift amount is small and is configured to execute side-shifting of the registration roller 61 and movement of the housing 435 by the housing moving mechanism 49 if the shift amount is large.

Modification

Figure 15A:
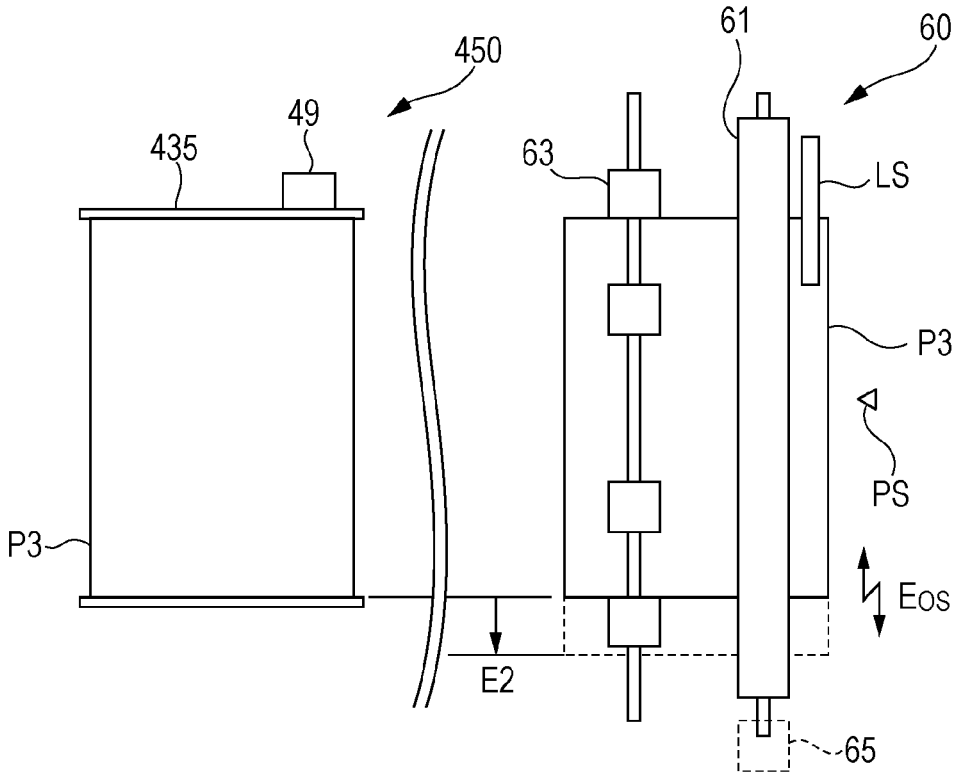
FIG. 15A illustrates the operation of a registration roller in an oscillation operation that is different from that in a modification.
Figure 15B:
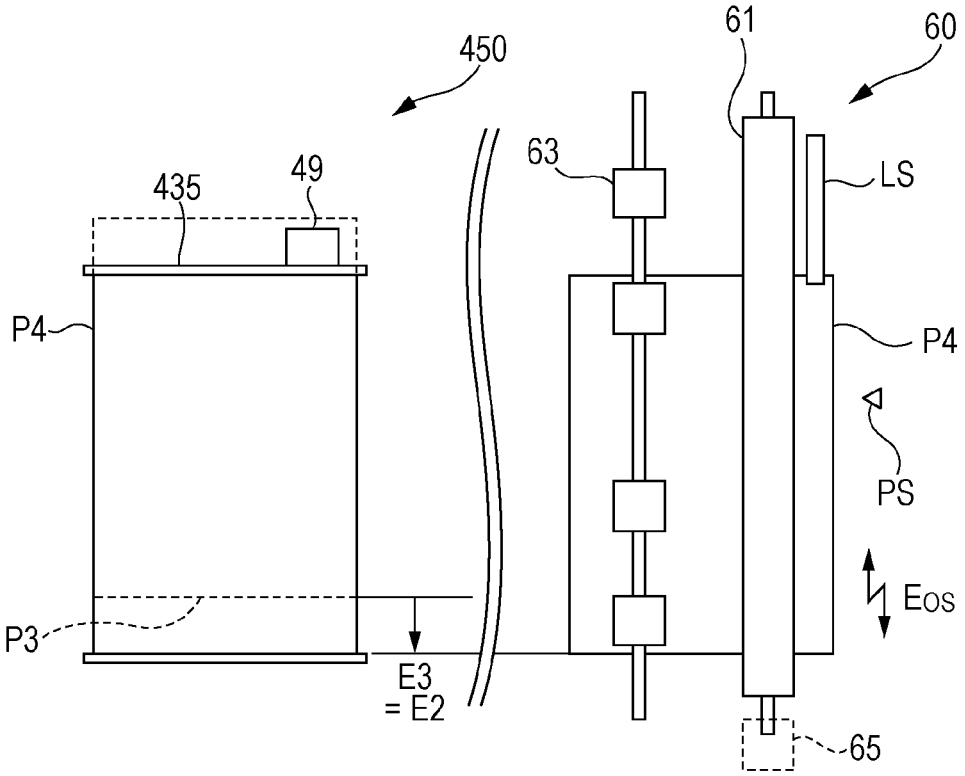
FIG. 15B illustrates the operation of a housing moving mechanism performed in connection with an oscillation operation according to the modification.

FIG. 15A illustrates the operation of the registration roller 61 in an oscillation operation that is different from that in this modification, and FIG. 15B illustrates the operation of the housing moving mechanism 49 performed in connection with an oscillation operation according to this modification.

In the image forming system 100, image forming operations are performed multiple times on sheets P of the same size, and the edges of the sheets P in the depth direction repeatedly pass through the same location, possibly damaging (scratching), for example, the intermediate transfer belt 20, the second-transfer roller 31, the heating belt 50A, or the pressing roller 50B.

In order to prevent such damage to the intermediate transfer belt 20 and so on, a so-called oscillation operation is sometimes performed in which the position where toner images are formed on the intermediate transfer belt 20 every time an image is formed onto a sheet P and the transport position (i.e., side registration position) of the sheet P in the depth direction are gradually moved within a predetermined range. The position where toner images are formed on the intermediate transfer belt 20 is changed by changing the timing at which the image forming units 10 as an example of image-position changing sections render the toner images.

With regard to the movement of the sheet P in accordance with this oscillation operation, in an oscillation operation that is different from that in this modification, as shown in FIG. 15A, the registration roller 61 moves within a predetermined range (see arrow Eos in FIG. 15A) so as to move the side registration position of a sheet P3. For example, in the oscillation operation, the registration roller 61 moves by a distance E2 from the home position.

In this case, since the registration roller 61 also performs side-shifting for normal side-registration adjustment, as described above with reference to FIGS. 8A to 8C, the registration roller 61 ultimately moves by a distance equivalent to a sum of the shift amount for normal side-shifting and the distance E2. Therefore, the shift amount of the registration roller 61 increases, possibly causing the sheet P3 to become skewed more readily in accordance with the movement of the registration roller 61.

Referring to FIG. 15B, when the oscillation operation is to be performed in the image forming system 100 according to this modification, the side registration position of a sheet P4 fed from any one of the first sheet feed device 410 to the sixth sheet feed device 460 is changed in advance (see arrow Eos in FIG. 15B). For example, if the sheet P4 is fed from the fifth sheet feed device 450, the housing moving mechanism 49 of the fifth sheet feed device 450 moves the housing 435 by a distance E3 (=distance E2) in the depth direction for moving the sheet P4 during the oscillation operation. Consequently, the shift amount of the registration roller 61 is minimized, thereby suppressing the occurrence of skew of the sheet P4 caused by the movement of the registration roller 61.

In the exemplary embodiment described above, if the average shift-amount value is larger than or equal to the threshold value, the integrated controller 80 discontinues the currently-executed job and moves the position of the housing 435 in the depth direction. Alternatively, the integrated controller 80 may proceed with the image forming operation without discontinuing the job and adjust the position of the housing 435 in the depth direction when executing a subsequent job upon completion of the currently-executed job. In the case where the position of the housing 435 in the depth direction is to be adjusted in a subsequent job without discontinuing the currently-executed job, a decrease in the output rate in the currently-executed job may be suppressed, as compared with the case where the currently-executed job is discontinued.

Furthermore, in the exemplary embodiment described above, the integrated controller 80 is configured to determine an average shift-amount value. This average shift-amount value may be an average shift-amount value of a sheet P transported after the current job is commenced or an average value of multiple consecutive sheets P (e.g., three sheets). As another alternative, the shift amount for a single sheet P may be used as the aforementioned average shift-amount value.

In the exemplary embodiment described above, the position of the housing 435 adjusted after discontinuing the job is maintained for subsequent jobs. Alternatively, the housing 435 may be returned to the home position when a subsequent job is to be executed. Furthermore, in the exemplary embodiment described above, the housing 435 is returned to the home position when the sheet accommodation section 43 is operated. Alternatively, even when the sheet accommodation section 43 is operated, the housing 435 may be maintained at the position prior to this operation.

In the exemplary embodiment described above, the moving distance of the housing 435 is determined based on the average shift-amount value. Alternatively, for example, an acquiring unit that acquires information about the sheet P, such as the thickness, the type, the basis weight, and the length, in the transport direction, of the sheet P, may be provided. Based on the information acquired by this acquiring unit and the average shift-amount value, the integrated controller 80 may determine the moving distance of the housing 435.

Furthermore, in the example described above with reference to FIG. 13B, the housing 435 is moved so that the shift amount of the registration roller 61 becomes zero. However, this does not eliminate a configuration in which the housing 435 is moved and the registration roller 61 further performs side-registration adjustment so long as the shift amount of the registration roller 61 is reduced by moving the housing 435.

In the above description, the integrated controller 80 determines whether to move the housing 435 for reducing the shift amount of the registration roller 61. Alternatively, the feed controller 380 or the processing controller 580 may have the aforementioned function of the integrated controller 80. Thus, the feed controller 380 may be considered as a load-position moving unit.

Furthermore, in the above description, the shift amount of the registration roller 61 is minimized by adjusting the position of the housing 435 so that the occurrence of skew is suppressed. In addition, the occurrence of creases in the sheet P may be suppressed by adjusting the position of the housing 435. Specifically, when the registration roller 61 moves in the depth direction while the registration roller 61 is holding only the leading edge of the sheet P in a state where the trailing edge of the sheet P receives transport resistance, the sheet P may sometimes bend. As the registration roller 61 rotates, this bent sheet P is drawn into the registration roller 61, possibly resulting in formation of creases in the sheet P. This occurrence of creases caused by the registration roller 61 may be suppressed by adjusting the position of the housing 435 in the above-described manner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

a feed section that feeds a sheet;

a transport section that transports the sheet fed from the feed section;

a transport position adjuster that adjusts a position of the sheet in an intersecting direction that intersects with a transport direction of the sheet transported by the transport section; and a load-position moving unit that calculates an adjustment amount, compares a predetermined amount with the adjustment amount, and if the adjustment amount is larger than the predetermined amount, the load-position moving unit moves the position, in the intersecting direction, of the sheet loaded in the feed section so as to reduce the adjustment amount by which the position is adjusted in the intersecting direction by the transport position adjuster.

2. The image forming system according to claim 1, wherein the load-position moving unit does not move the position, in the intersecting direction, of the sheet loaded in the feed section if the adjustment amount by the transport position adjuster is smaller than the predetermined amount.

3. The image forming system according to claim 1, further comprising:

a transport path that transports the sheet fed from the feed section toward the transport position adjuster and that has a curve portion that is curved so as to change the transport direction of the sheet, wherein the transport position adjuster adjusts the position of the sheet in the intersecting direction in a state where at least a part of the sheet exists in the curve portion of the transport path.

4. The image forming system according to claim 1, further comprising:

an image forming section that forms an image onto the sheet whose position in the intersecting direction is adjusted by the transport position adjuster; and an image-position changing section that changes a position, in the intersecting direction, of the image formed by the image forming section, wherein the load-position moving unit moves the position, in the intersection direction, of the sheet loaded in the feed section in accordance with the position of the image changed in the intersecting direction by the image-position changing section.

5. The image forming system according to claim 1, wherein the transport position adjuster corrects skew of the sheet fed from the feed section and adjusts the position of the skew-corrected sheet in the intersecting direction.

6. An image forming apparatus comprising:

a receiving section that receives a sheet fed from a feed section;

a transport position adjuster that adjusts a position of the sheet in an intersecting direction that intersects with a transport direction of the sheet received by the receiving section; and a load-position controller that calculates an adjustment amount, compares a predetermined amount with the adjustment amount, and if the adjustment amount is larger than the predetermined amount, the load-position controller controls the feed section so as to move the position, in the intersecting direction, of the sheet loaded in the feed section and to reduce the adjustment amount by which the position is adjusted in the intersecting direction by the transport position adjuster.

7. A sheet feed apparatus comprising:

a sheet load section in which a sheet to be fed to an image forming apparatus is loaded; and a load-position moving unit calculates an adjustment amount, compares a predetermined amount with the adjustment amount, and if the adjustment amount is larger than the predetermined amount, the load-position moving unit that moves a position, in an intersecting direction, of the sheet loaded in the sheet load section so as to reduce the adjustment amount by which a position of the sheet fed from the sheet load section to the image forming apparatus is adjusted in the intersecting direction at the image forming apparatus, the intersecting direction intersecting with a transport direction of the sheet.

8. An image forming method comprising:

feeding a sheet;

transporting the fed sheet;

adjusting a position of the sheet in an intersecting direction that intersects with a transport direction of the transported sheet;

calculating an adjustment amount;

comparing a predetermined amount with the adjustment amount; and if the adjustment amount is larger than the predetermined amount, moving the position, in the intersecting direction, of the sheet so as to reduce the adjustment amount by which the position is adjusted in the intersecting direction.

* * * * *